US005474230A

United States Patent [19]

Yotukura

[11] Patent Number: 5,474,230

[45] Date of Patent: Dec. 12, 1995

[54] FOLDING BOX

[75] Inventor: Masakatu Yotukura, 11-12, Osonedai, Kohoku-ku, Yokohama-shi, Japan

[73] Assignees: Hitachi Kasei Shoji Co., Ltd., Tokyo; Masakatu Yotukura, Yokohama, both of Japan

[21] Appl. No.: 136,088

[22] Filed: Oct. 14, 1993

[30] Foreign Application Priority Data

| | | | |
|---|---|---|---|
| Oct. 16, 1992 | [JP] | Japan | 4-303161 |
| Apr. 13, 1993 | [JP] | Japan | 5-108777 |
| Apr. 30, 1993 | [JP] | Japan | 5-124709 |

[51] Int. Cl.[6] ..... B65D 5/36; B65D 88/52

[52] U.S. Cl. ..... 229/117.04; 206/600; 229/117.03; 229/117.05; 229/117.16; 229/126; 229/127; 229/143; 229/199; 229/915; 229/918

[58] Field of Search ..... 229/117.01, 117.03, 229/117.04, 117.05; 206/386, 600

[56] References Cited

U.S. PATENT DOCUMENTS

| | | | |
|---|---|---|---|
| 756,311 | 4/1904 | Adams | 229/117.05 |
| 2,271,962 | 2/1942 | Weiner | 229/117.03 |
| 2,930,517 | 3/1960 | Mensing et al. | 229/117.01 |
| 3,199,762 | 8/1965 | Coons | 229/117.05 |
| 4,129,248 | 12/1978 | Casutt | 229/117.05 |
| 4,373,637 | 2/1983 | Shippell | 229/117.01 |
| 4,712,687 | 12/1987 | Silcott et al. | 206/600 |
| 4,760,922 | 8/1988 | Northgrave | 229/117.01 |
| 4,793,507 | 12/1988 | Delplanque . | |
| 5,090,614 | 2/1992 | Kupersmit | 229/117.04 |
| 5,301,872 | 4/1994 | Tusing et al. | 229/117.03 |

FOREIGN PATENT DOCUMENTS

| | | | |
|---|---|---|---|
| 1121070 | 7/1968 | United Kingdom | 229/117.01 |
| 2137170 | 3/1983 | United Kingdom . | |

*Primary Examiner*—Gary E. Elkins
*Attorney, Agent, or Firm*—Antonelli, Terry, Stout & Kraus

[57] ABSTRACT

A folding box includes a pair of opposed first side walls each foldable along a vertical direction, a pair of opposed second side walls, and a pair of bottom plates. Each bottom plates includes a central trapezoidal portion and a pair of triangular portions hingedly connected respectively to opposite sides of the trapezoidal portion. With this construction, the box made, for example, of a corrugated board can be folded into a compact size, so that the area of the folded box is small.

4 Claims, 36 Drawing Sheets

FOLDING BOX

BACKGROUND OF THE INVENTION

This invention relates to a folding box made of a boxboard (cardboard) such as a corrugated board, a thin synthetic resin street, or the like.

Most of conventional folding corrugated boxes have a bottom constituted by four portions which extend respectively from four side walls of the box, and can be folded and combined together. For folding the box, the four bottom portions are expanded, and are folded between the side walls.

Since the bottom of such a folding corrugated box comprises the four small portions extending respectively from the four side walls, the bottom is weak, and when the box holds a heavy article, the bottom is frequently broken or opened.

Furthermore, such a box can be easily deformed by a force applied obliquely thereto, and in such a case the four side walls are displaced with respect to one another, so that the box is twisted as a whole.

Furthermore, since the box is folded in such a manner that the side walls move toward each other, the box in a folded condition is rather long, and therefore the area of the folded box is rather large.

SUMMARY OF THE INVENTION

It is an object of this invention to provide a folding box of a boxboard such as a corrugated board or a thin synthetic resin sheet which provides a sufficient strength in an assembled condition, and the folded box has a relatively small area.

According to a first aspect of the present invention, there is provided a folding box comprising:

first side walls each inwardly foldable at a vertically-extending hinge provided at a central portion thereof;

second side walls connected to the first side walls, the second side wall having end portions disposed generally perpendicularly to a remainder of the second side wall, so that the second side walls have a generally U-shaped cross-section; and two bottom plates each including a trapezoidal portion and a pair of triangular portions hingedly connected at respective folding lines to side edges of the trapezoidal portion, the trapezoidal portions being hingedly connected respectively to a lower edge of the second wall portions, the triangular portions of each of the bottom plates being hingedly connected respectively to lower edges of the first side walls, and a boundary between the two bottom plates being disposed in registry with the central hinges of the first wall portions.

Each triangular portion of the bottom plate can be connected to the lower edge of the first side wall through a crease portion, and with this arrangement, even when the side walls and the bottom plates are made of a relatively thick board, the box can be folded.

A reinforcement bottom plate, which has generally the same shape as a configuration defined by the pair of bottom plates, and has generally the same area as combined areas of the two bottom plates, can be pivotally connected at one end to the lower edge of one second side wall. This reinforcement bottom plate will not affect the folding of the box, and serves to reinforce the bottom plates and also to prevent the deformation of the box.

The box of the present invention can be folded at the central portions of the first side walls along the vertical direction, and therefore the folded box can be smaller than conventional boxes in a folded condition. The first and second side walls and the bottom plates can be made of a corrugated board, a thin synthetic resin sheet, or the like.

According to a second aspect of the invention, there is provided a folding box comprising:

first side walls each inwardly foldable at a vertically-extending hinge provided at a central portion thereof;

second side walls connected to the first side walls, the second side walls including a main wall portion, end wall portions connected generally perpendicularly to ends of the main wall portion, respectively, so that the second side walls have a generally U-shaped cross-section, the second side wall further including a bottom wall portion connected to lower edges of the main wall portion and the end wall portions; and two thin bottom plates each including a trapezoidal portion and a pair of triangular portions hingedly connected at respective folding lines to side edges of the trapezoidal portion, each of the trapezoidal portions being hingedly connected to one edge of the bottom wall portion of a respective one of the second side wall portions which is remote from the main wall portion, the triangular portions of each of the bottom plates being hingedly connected respectively to lower edges of the first side walls, and the two bottom plates being held in contact with each other in an assembled condition of the box, thereby providing a bottom of the box;

at least one reinforcement bottom plate pivotally connected at one end to the lower edge of one of the second side walls.

According to a third aspect of the invention, there is provided a folding box comprising:

a pair of first side walls each inwardly foldable at a vertically-extending hinge provided at a central portion thereof;

a pair of second side walls disposed between the first side walls;

connection members each disposed between the adjacent first and second side walls to hingedly connect them together;

a bottom plate including two trapezoidal portions hingedly connected respectively to lower edges of the two second side walls for being turned toward the second side walls, respectively, the bottom plate further including four triangular portions two of which are hingedly connected to a lower edge of one of the first side walls for being turned toward the one first side wall whereas the other two triangular portions are hingedly connected to a lower edge of the other first side wall for being turned toward the other first side wall, a boundary between the two triangular portions being disposed in registry with the central hinge of the corresponding first side wall, the four triangular portions being hingedly connected at respective folding lines respectively to opposite side edges of the two trapezoidal portions, portions of the bottom plate engaging each other to prevent the bottom plate from being folded;

reinforcement means for preventing the bottom plate from being folded;

there being provided small holes which are formed in the bottom plate.

The box of the invention is simple in construction, and the area of the folded box is small, and the box in an assembled condition has a sufficient strength.

According to the present invention, various modified boxes can be provided as specifically described with respect to the following embodiments of the invention, and these modified boxes can achieve the object of the invention, and have excellent advantages.

DESCRIPTION OF THE PREFERRED EMBODIMENTS

Figure 1:
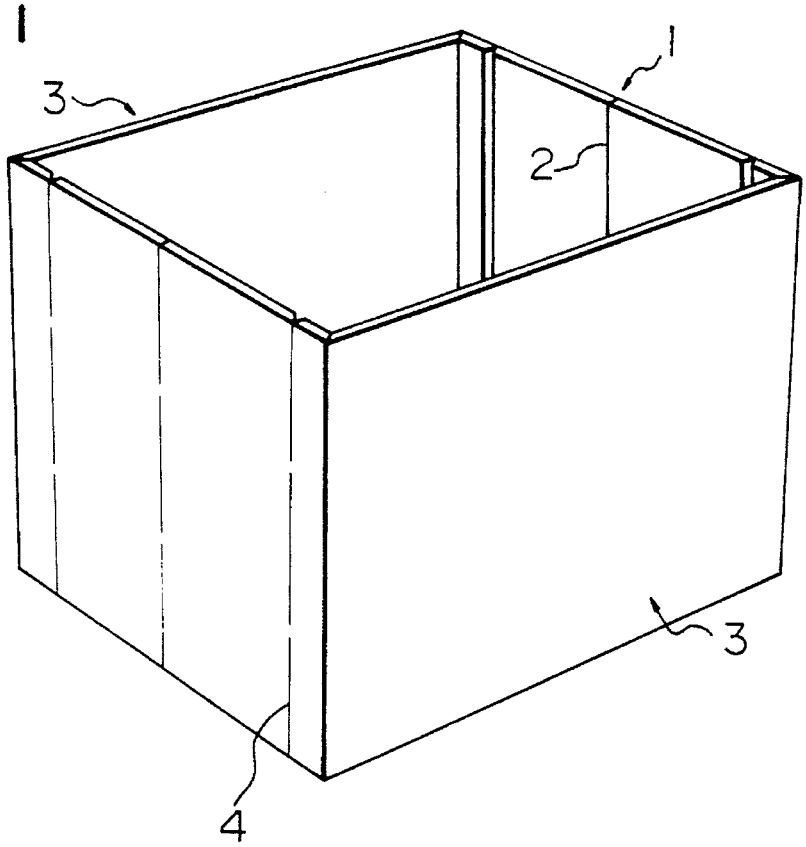
FIG. 1 is a perspective view of a preferred embodiment of a box of the present invention in an assembled condition.
Figure 2:
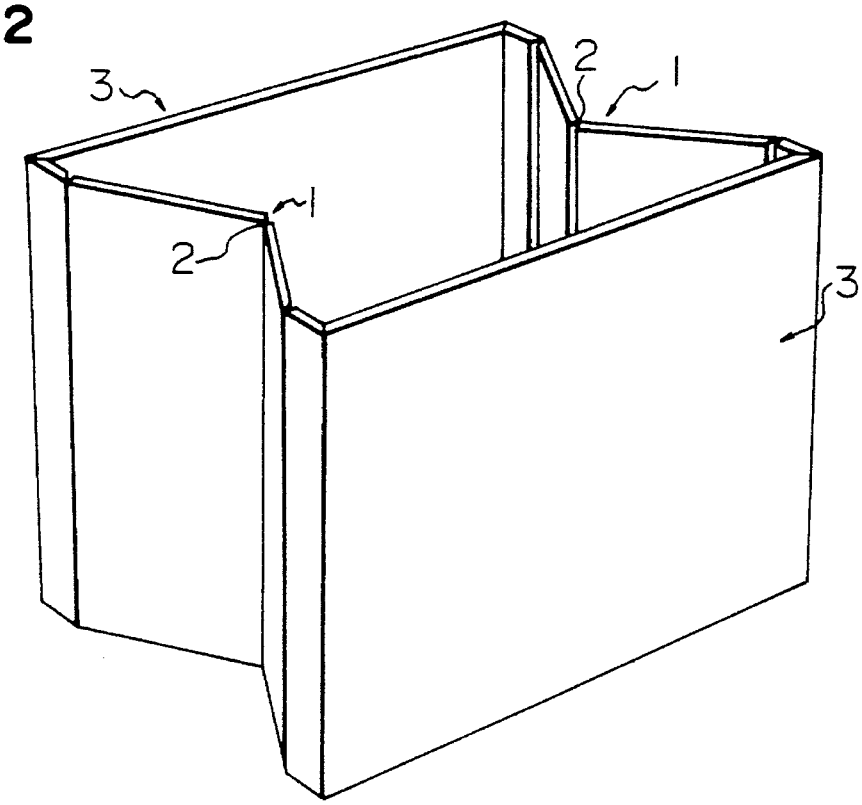
FIG. 2 is a view showing the box during a folding operation.
Figure 3:
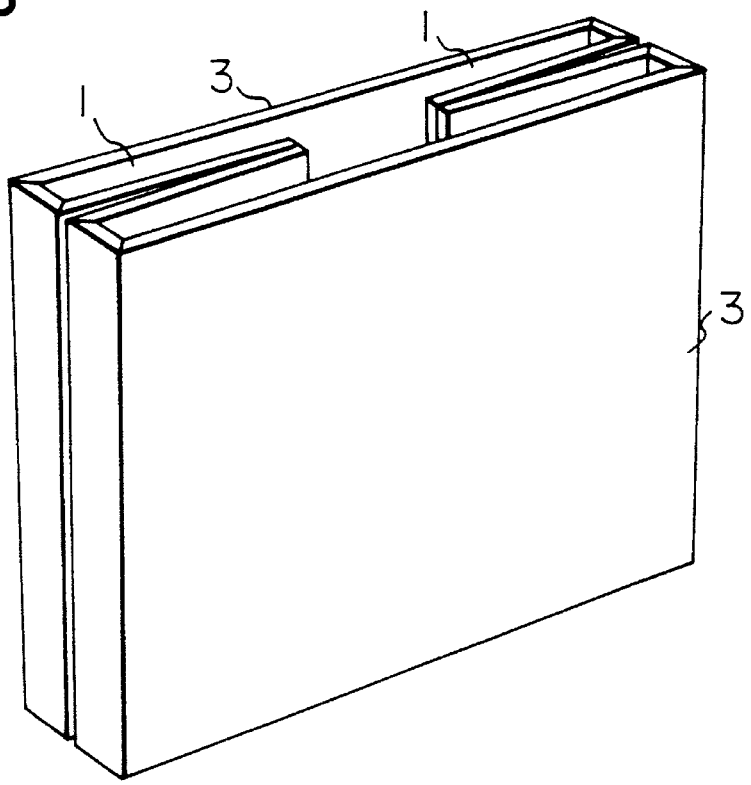
FIG. 3 is a view showing the box in a folded condition.

A preferred embodiment of a folding box of the present invention will now be described. FIG. 1 shows the box of the present invention in an assembled condition, FIG. 2 shows the box during the folding operation, and FIG. 3 shows the box in a folded condition. As shown in these Figures, the box comprises a pair of first side walls 1 each foldable inwardly at a hinge 2 provided at a central portion thereof, a pair of second side walls 3 of a generally U-shaped cross-section integrally connected to the first side walls 1 by hinges 4, as shown in FIG. 1, and a bottom portion connected to the first and second side walls 1 and 3.

Figure 4:
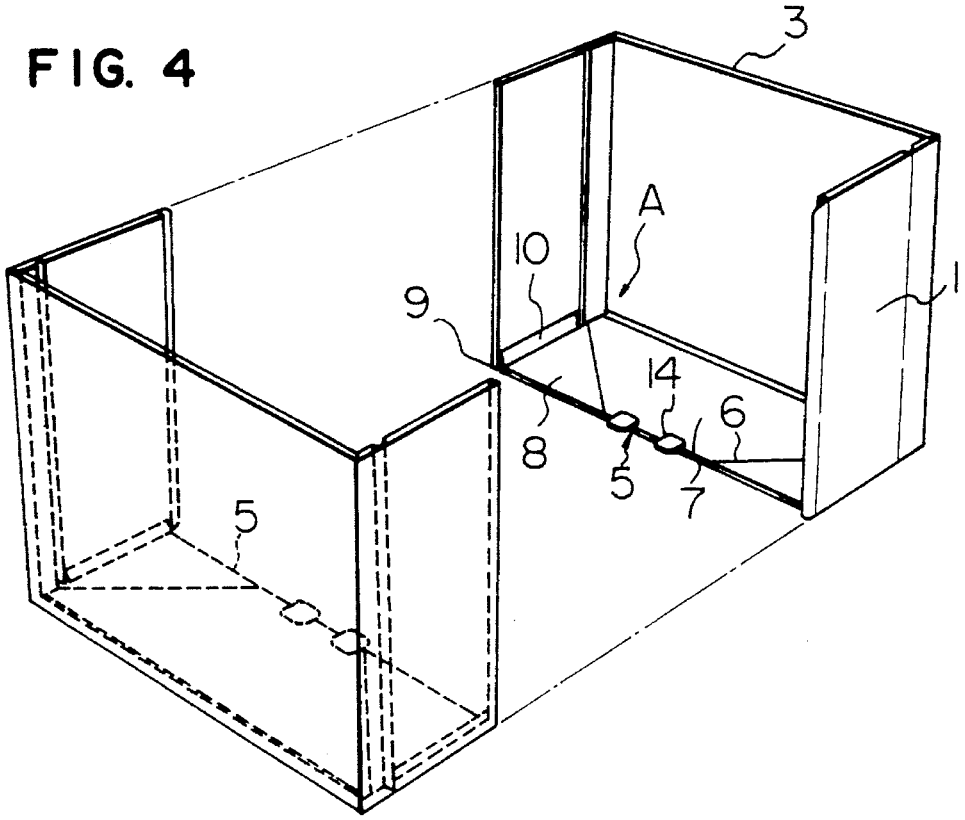
FIG. 4 is an exploded perspective view of the box.

FIG. 4 is an exploded perspective view of the box, showing the inside of the box and the bottom plates.

The bottom portion is constituted by a pair of bottom plates 5 each including a trapezoidal portion 7 and two triangular portions 8. The boundary between the trapezoidal portion 7 and each triangular portion 8 defines a folding line 6. The triangular portion 8 can be inwardly turned at a connection portion 9 at which the bottom plate 5 and the foldable side wall 1 are connected together. Therefore, simultaneously when each first side wall 1 is folded at its central portion at the hinge 2, the triangular portions 8 and the trapezoidal portion 7 of each bottom plate 5 are turned inwardly, and these portions are received in the second side wall 3 of a U-shaped cross-section, thus achieving the folded operation as shown in FIG. 3.

Namely, right and left portions (two halves) shown in FIG. 4 are integrally connected together by connecting pieces to form the box shown in FIG. 1. Simultaneously when the foldable side walls 1 are folded inwardly at the hinges 2, the bottom plates 5 are folded inwardly at the folding lines 6, so that the box begins to be folded as shown in FIG. 2 and is brought into the folded condition (FIG. 3).

As described above, the box of this embodiment is made of a corrugated board, a thin synthetic resin sheet or the like, and has a predetermined wall thickness. If the two bottom plates 5 are formed into a one-piece construction, it is difficult to fold the first side walls 1 inwardly in such a manner that such a single bottom plate connected to the side walls 1 is folded upwardly at the folding lines 6, and in this case the two portions of the single bottom plate corresponding respectively to the pair of bottom plates 5 pull each other, so that the folding of the box becomes impossible. Therefore, the bottom plate is divided into the two portions (halves) 5, and with this arrangement each bottom plate 5 is folded inwardly toward the second side wall 3, thereby enabling the folding of the box.

Figure 5A:
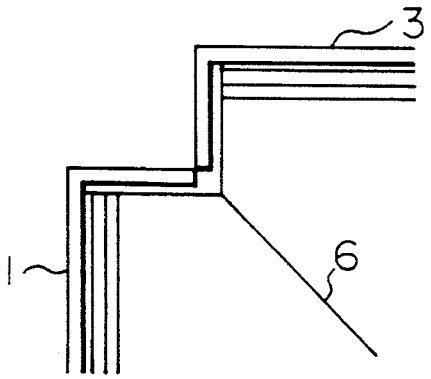
FIGS. 5A and 5B are views of a first folding principle.
Figure 5B:
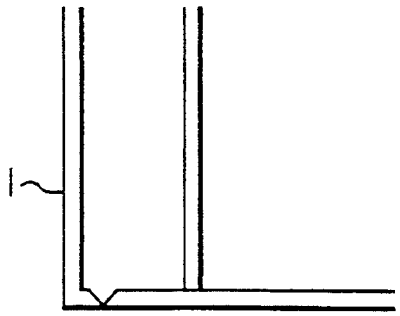

At that portion of the box indicated by reference numeral A in FIG. 4, when the bottom plate 5 is folded inwardly at the folding lines 6 in such a manner that the folding lines 6 moves upward, it is necessary to fold the box at the boundary between each foldable first side wall 1 and the bottom plate 5 and at the boundary between each U-shaped second side wall 3 and the bottom plate 5 at the same time. To enable this simultaneous folding, it is necessary that the first side wall 1 and the second side wall 3 should be symmetrical with respect to the folding line 6 and be equidistant from the folding line 6. If this requirement is met, the folding is possible. If the material constituting the side walls 1 and 3 is thin as described above, there is no problem, but if the material is thick, the folding becomes difficult even if the above requirement is satisfied. Therefore, in this embodiment, assuming that the material of the sheet is relatively thick, a connection portion between the first side wall 1 and the triangular portion 8 of the bottom plate 5 is constituted by a crease 10 foldable, so that this connection portion can be easily folded even if the sheet material is thick. FIGS. 5A, and B, 6A and B and 7A and B show folding means near the folding line in the case where the sheet material is thick. In FIGS. 5A, and B reference numeral 1 denotes the first side wall of the box of this embodiment, reference numeral 3 the second side wall, and reference numeral 6 the folding line. A broken line shows the position of the corner portion in the case where the first side wall 1, the second side wall 3 and the bottom plate 5 are simply connected together in a manner to achieve the folding.

In this Figure, where the first side wall 1, the second side wall 3 and the bottom plate 5 are relatively thick, these thick portions interfere with one another in the condition indicated by the broken line, thereby disenabling the folding. To avoid this, the corner portion of the side wall 1 is folded inside as shown in FIG. 5A to absorb the thickness of the bottom plate 5. However, if the corner portion is thus folded inside, the folded corner portion presses the contents of the box in the assembled condition of the box. This is not desirable.

Figure 6A:
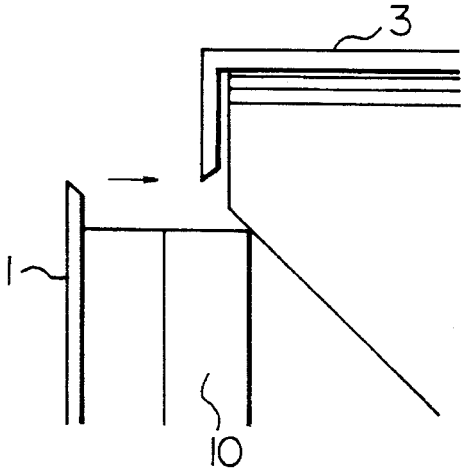
FIGS. 6A and 6B are views similar to FIGS. 5A and 5B, but showing a second folding principle.
Figure 6B:
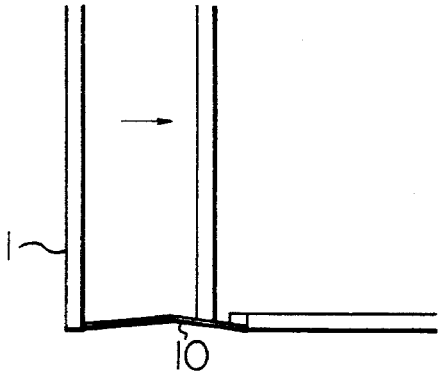

In FIG. 6A, the side of the square notched portion of FIG. 5A is removed, and also that portion of the bottom plate surrounded by this side, the side wall and a line extending parallel thereto is cut off, and this portion is replaced by a flexible material 10 (e.g. a thin sheet of paper or a film of a synthetic resin) which can be easily folded. In this case, also, the folding is possible as in the construction of FIGS. 5A and B, and by virtue of the provision of the flexible portion 10, the folding can be effected more easily.

Figure 7A:
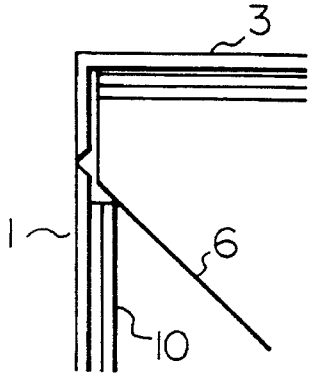
FIGS. 7A and 7B are views similar to FIGS. 5A and 5B, but showing a third folding principle.
Figure 7B:
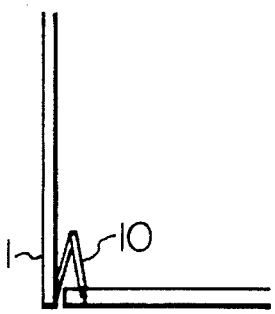

In FIGS. 7A and B, the flexible portion 10 of FIGS. 6A and B is suitably folded, for example, as shown in FIG. 7B, and the side wall and the wall of the square notched portion are connected together by a hinge. This construction shown in FIGS. 7A and B is the construction of the portion indicated by reference numeral A in the embodiment of FIG. 4, and the flexible portion 10 is the crease portion.

In the embodiment of FIGS. 1 to 4, even if a thick sheet material is used for forming the side walls and the bottom plates, the folding of the box can be effected in the above-mentioned manner.

Figure 8:
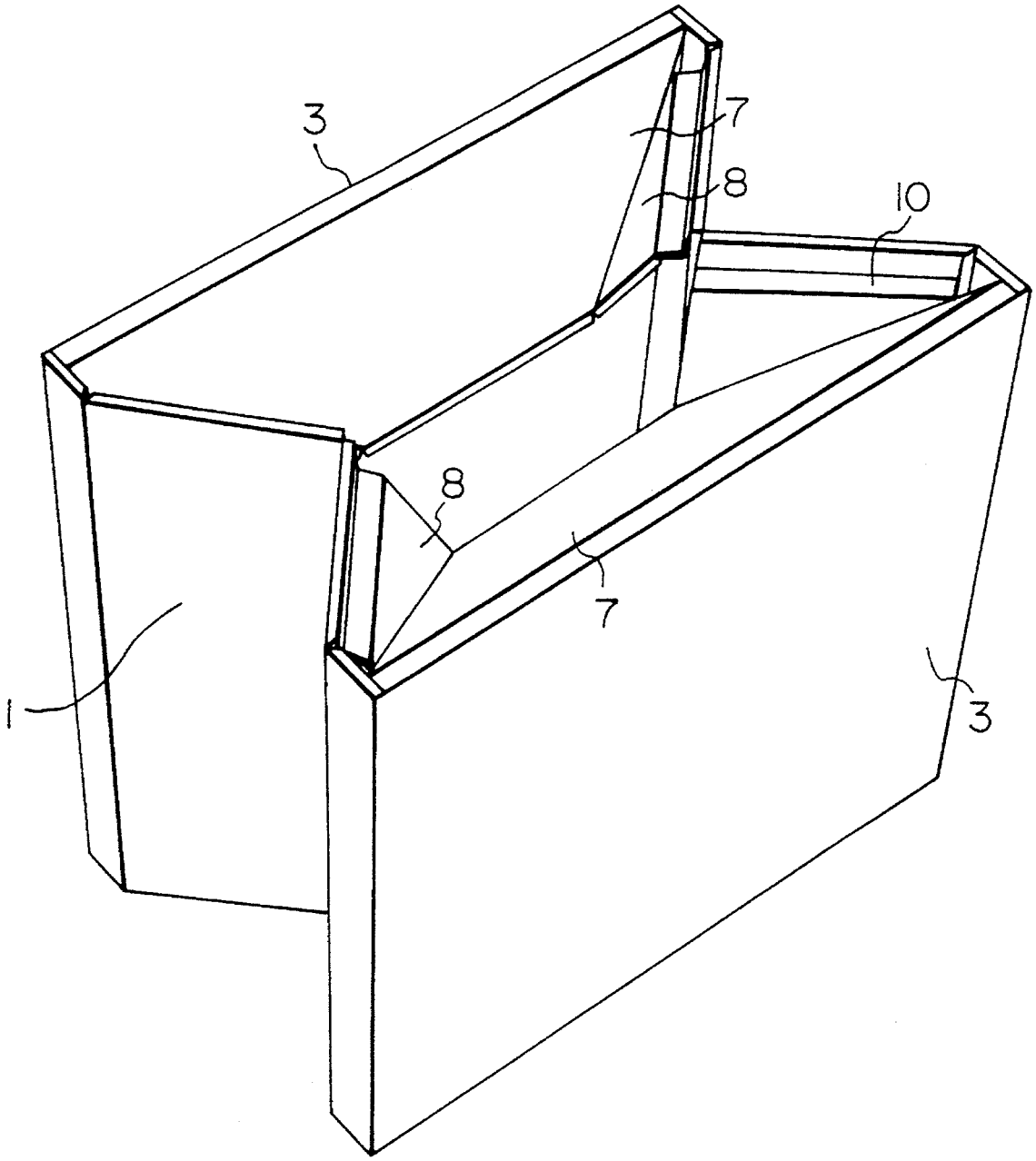
FIG. 8 is view showing the process of folding of bottom plates from the bottom side of the box.
Figure 9:
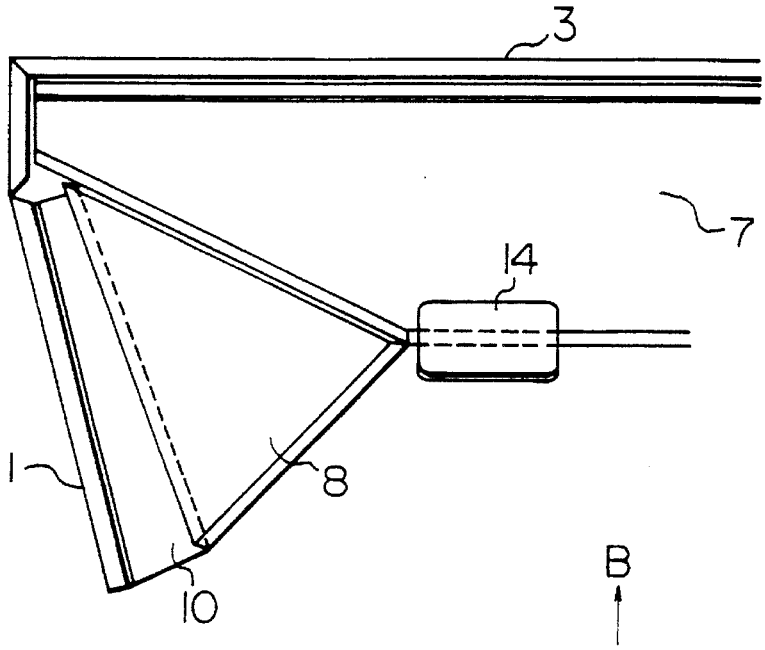
FIG. 9 is a view showing the process of folding of the bottom plates from the upper side thereof.
Figure 10:
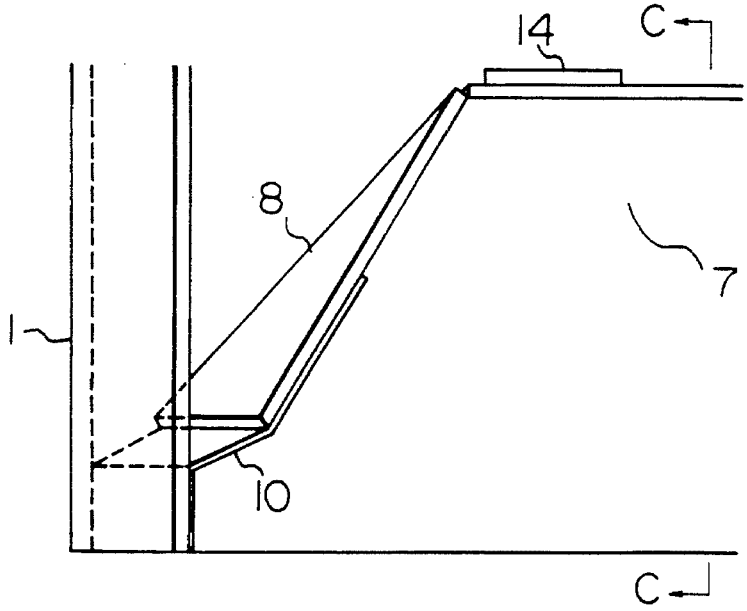
FIG. 10 is a view as seen in a direction of arrow B of FIG. 9.
Figure 11:
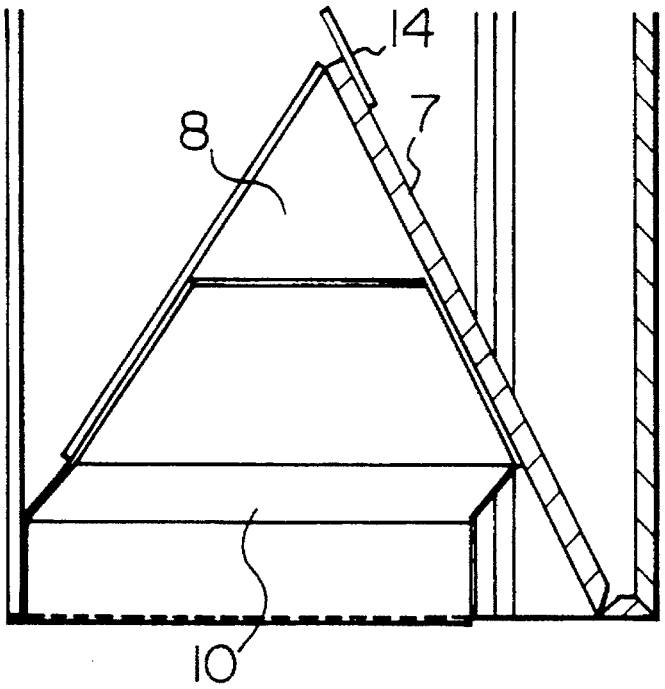
FIG. 11 is a cross-sectional view taken along the line C—C of FIG. 10.

FIGS. 8 to 10 show the process of folding the box of this embodiment. FIG. 8 is a view as seen from the bottom side of the box, and when each first side wall 1 is folded, the trapezoidal portion 7 and the triangular portions 8 of each bottom plate is turned, so that the bottom plate is folded inwardly into the box. FIGS. 9 to 11 show this condition, as seen from the inside. FIG. 10 is a view as seen in a direction of arrow B of FIG. 9, and FIG. 11 is a cross-sectional view taken along the line C—C of FIG. 10.

Figure 12:
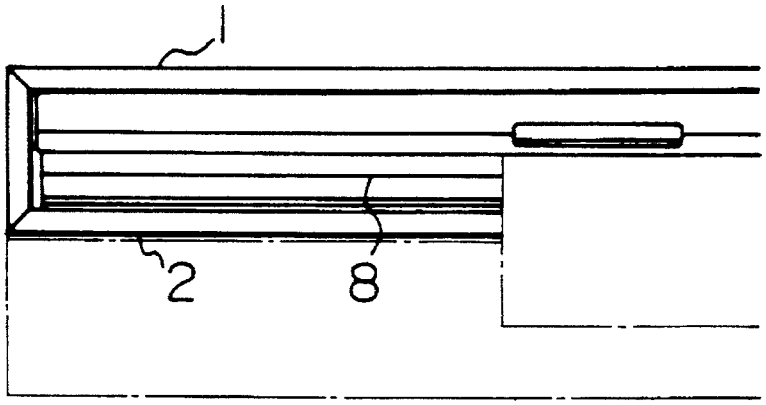
FIG. 12 is a view showing the bottom plates in their folded condition.

The trapezoidal portion 7 is disposed in contiguous relation to the second side wall 3, and the triangular portions 8 are turned to overlap the folded first side wall 1, so that these portions overlap one another in contiguous relation, as shown in FIG. 12. Namely, the bottom plate 5 received between the folded first side walls 1 and the second side wall 3 of a U-shape.

Figure 13:
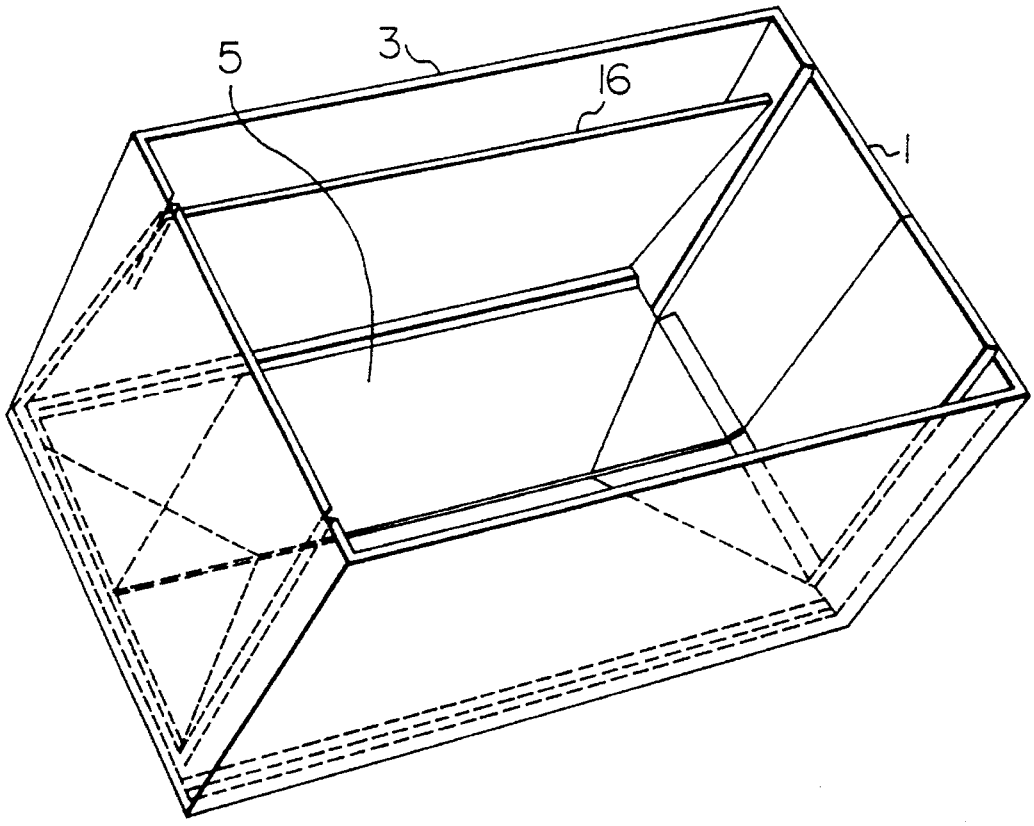
FIG. 13 is a perspective view of a modified box having a reinforcement bottom plate.

FIG. 13 is a perspective view of a modified box of the invention. In this embodiment, in order that the box can be folded even when it is made of a thick material, the bottom of the box is constituted by a pair of bottom plates 5 of an identical shape, and the boundary between the pair of bottom plates 5 is reinforced. More specifically, a reinforcement bottom plate 16, having the same area as combined areas of the two bottom plates 5, is pivotally connected to the boundary between one of two U-shaped second side walls 3 and the bottom plate 5 connected thereto.

In this embodiment, after the box is assembled, the reinforcement bottom plate 16 is laid flat against the pair of bottom plates 5 to reinforce them. At the same time, the peripheral edge of the reinforcement bottom plate 16 urges the side walls 1 and 3 outwardly, thereby increasing the strength of the box.

Figure 14:
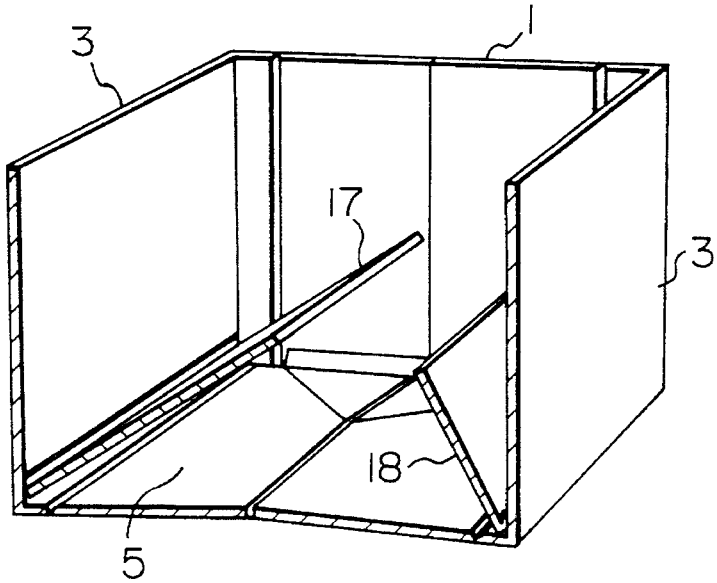
FIG. 14 is a view of another modified box having a reinforcement bottom plate.

FIG. 14 shows another embodiment in which reinforcement bottom plates are provided in a shallow box. As shown in FIG. 14, two reinforcement bottom plates 17 and 18 different in width (a dimension from a pivotal edge to a free or distal edge) from each other are pivotally mounted. Even when a single reinforcement bottom plate of a larger size for covering entire inner surfaces of two bottom plates 5 can not be mounted on the box because the height or depth of the box is small, the bottom of the box can be reinforced in this embodiment. In this embodiment, when the two reinforcement bottom plates 17 and 18 are laid flat against the bottom plates 5, the distal ends of the two plates 17 and 18 are abutted against each other, and the boundary between the distal ends of the two plates 17 and 18 is not in registry with the boundary between the pair of bottom plates 5. This effectively reinforces the bottom plates 5.

If two reinforcement bottom plates different in width from each other are used when the height or depth of the box is about half the length of the second side wall 3, the wider reinforcement bottom plate is projected outwardly from the side wall in the folded condition of the box. This is undesirable. In such a case, two reinforcement bottom plates equal in width may be used. With this arrangement, each bottom plate 5 is prevented from being folded at folding lines 6.

Figure 15:
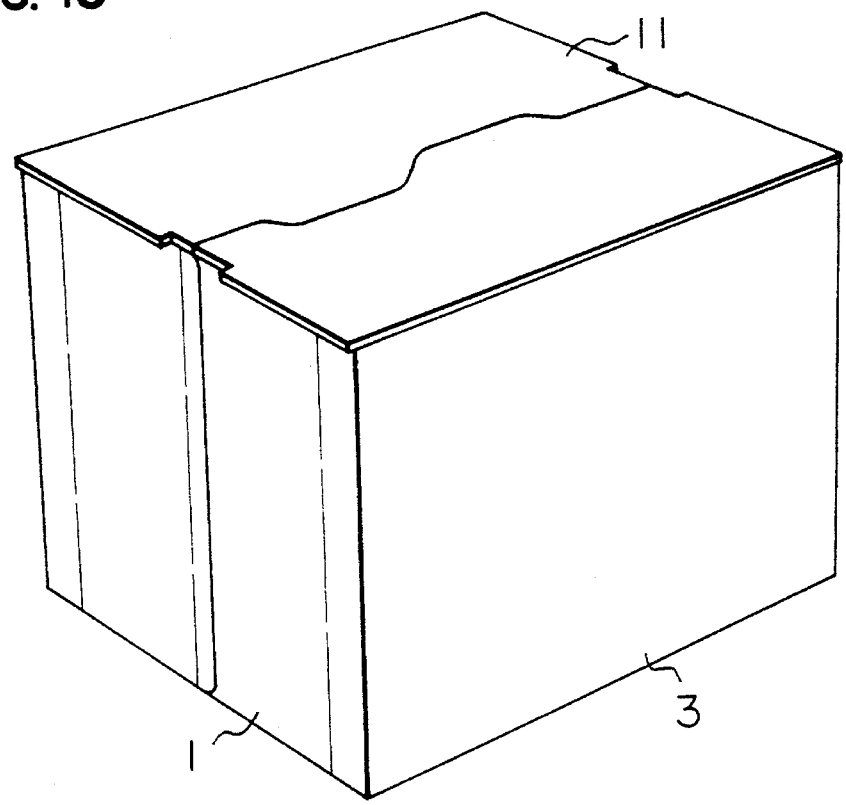
FIG. 15 is a perspective view of a further modified box with lids.

FIG. 15 shows a further modified box with lids 11, which is the same construction as that of the above embodiments except for the lids 11. The two lids 11 are pivotally connected at their one ends to upper edges of two second side walls 3, respectively.

Figure 16:
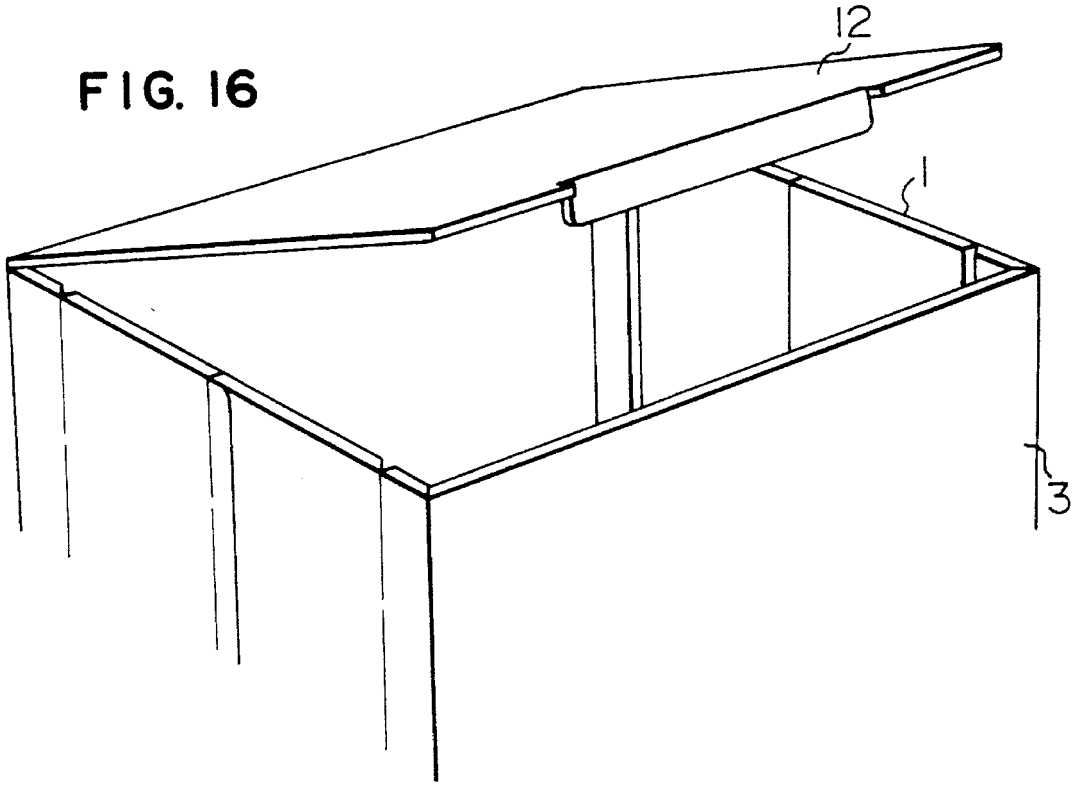
FIG. 16 is a view of a further modified box with a lid.

FIG. 16 is a further modified box with a lid 12, and the lid 12 is pivotally connected at one end to an upper edge of one side wall 3.

Thanks to the provision of the lid or lids, the box has an increased strength in the assembled condition, and such boxes can be stacked one upon another.

Figure 17:
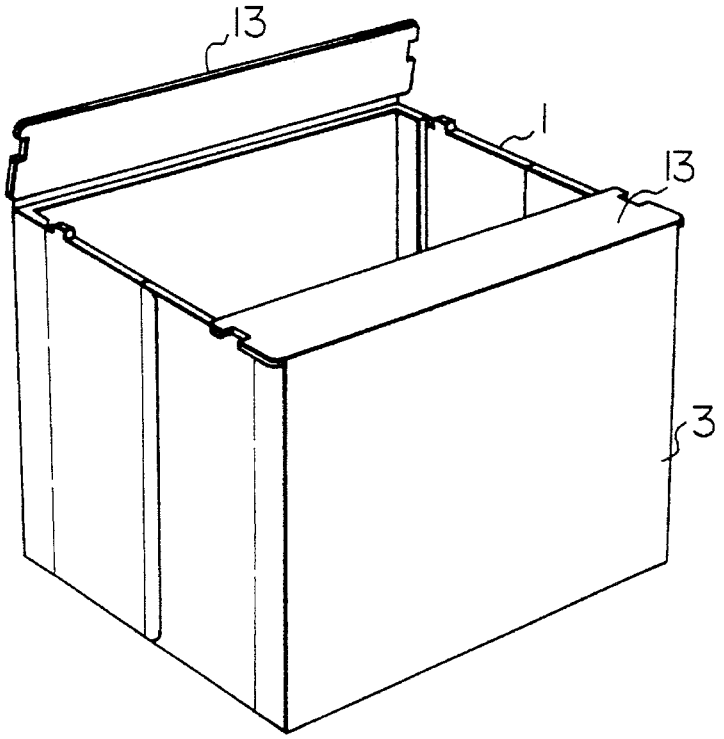
FIG. 17 is a view of a further modified box with stacking plates.
Figure 18:
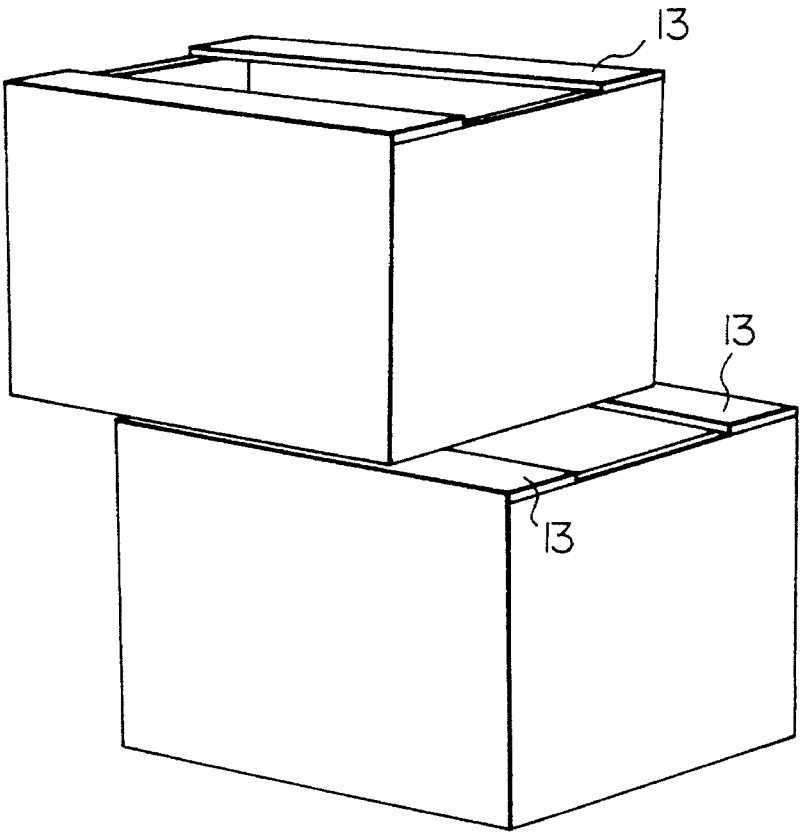
FIG. 18 is a view showing the box of FIG. 17 in a stacked condition.

FIG. 17 shows a further modified box having a pair of box-stacking plates 13 pivotally mounted respectively on upper edges of two second side walls 3 so as to cover the opposite side portions of the top of the box, and FIG. 18 shows two such boxes stacked one upon the other. With this construction, the box can be firmly fixed in its assembled condition, and these boxes can be stacked one upon another, as is the case with the boxes of FIGS. 15 and 16 having the lid or lids. In this embodiment, even when the box-stacking plates 13 are held in their closed positions, the contents of the box can be viewed, and also an article can be put into and out of the box.

Figure 19:
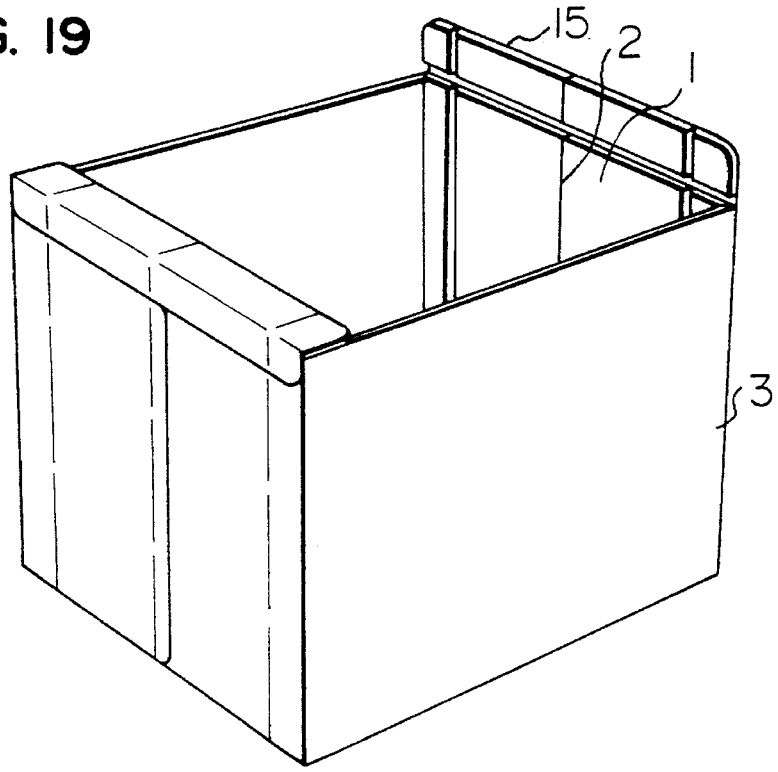
FIG. 19 is a view showing a further modified box with means for preventing the folding of each first side wall.

In the above embodiments, elements 14 serve to prevent the bottom of the box from being folded at the line of connection between the pair of bottom plates 5. FIG. 19 shows a further modified box having a pair of members 15 for preventing a pair of first side walls 1 from being folded at their respective hinges 2, the members 15 being mounted respectively on upper edges of the first side walls 1.

The material of which the boxes of the above embodiments are made may be any other suitable material than a corrugated board, such as a cardboard (boxboard) and a thin synthetic resin sheet.

A flexible film as used in the box of FIG. 4, or a hinge may be used to form the hinged portions and the folding lines of the above boxes. Although it is preferred that the box be constituted by a one-piece sheet, the box may be constituted by separate sheets combined together if this is desirable from a manufacturing point of view.

Figure 20:
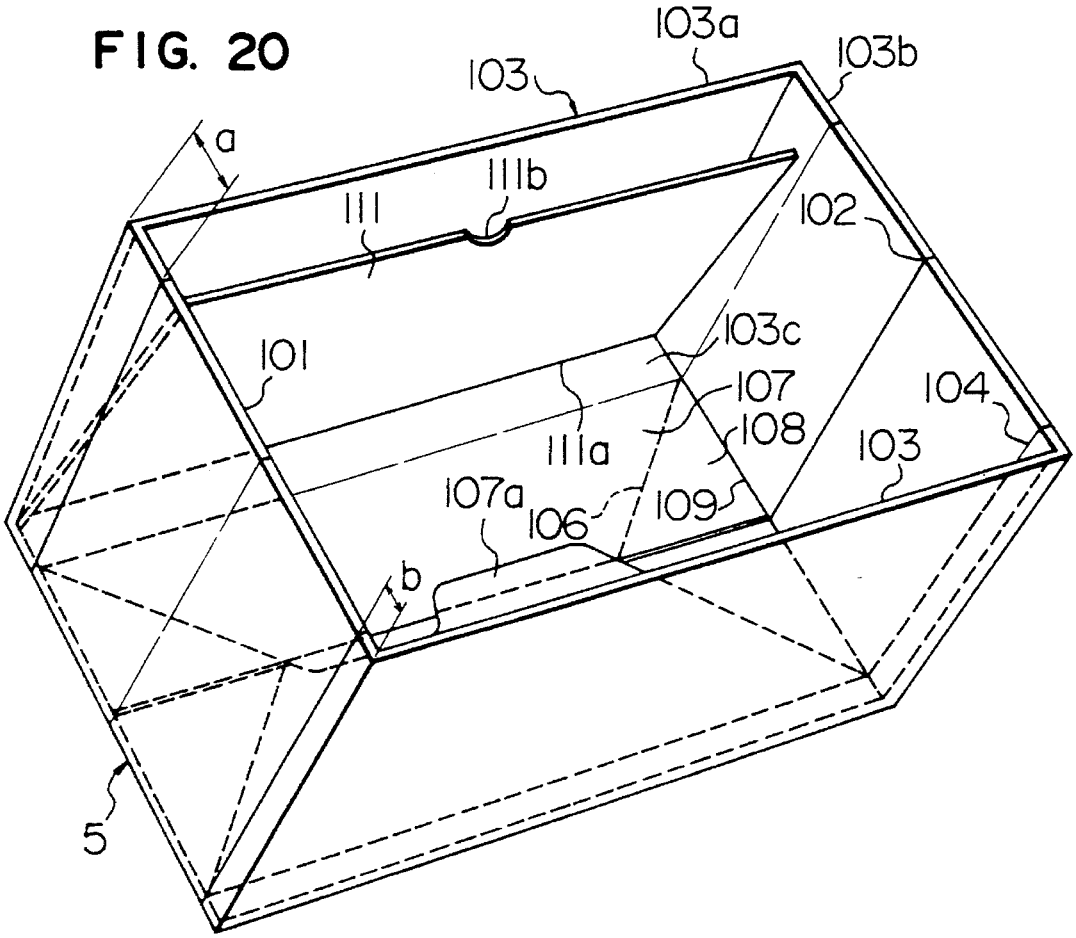
FIG. 20 is a perspective view of a further modified box in an assembled condition.
Figure 21:
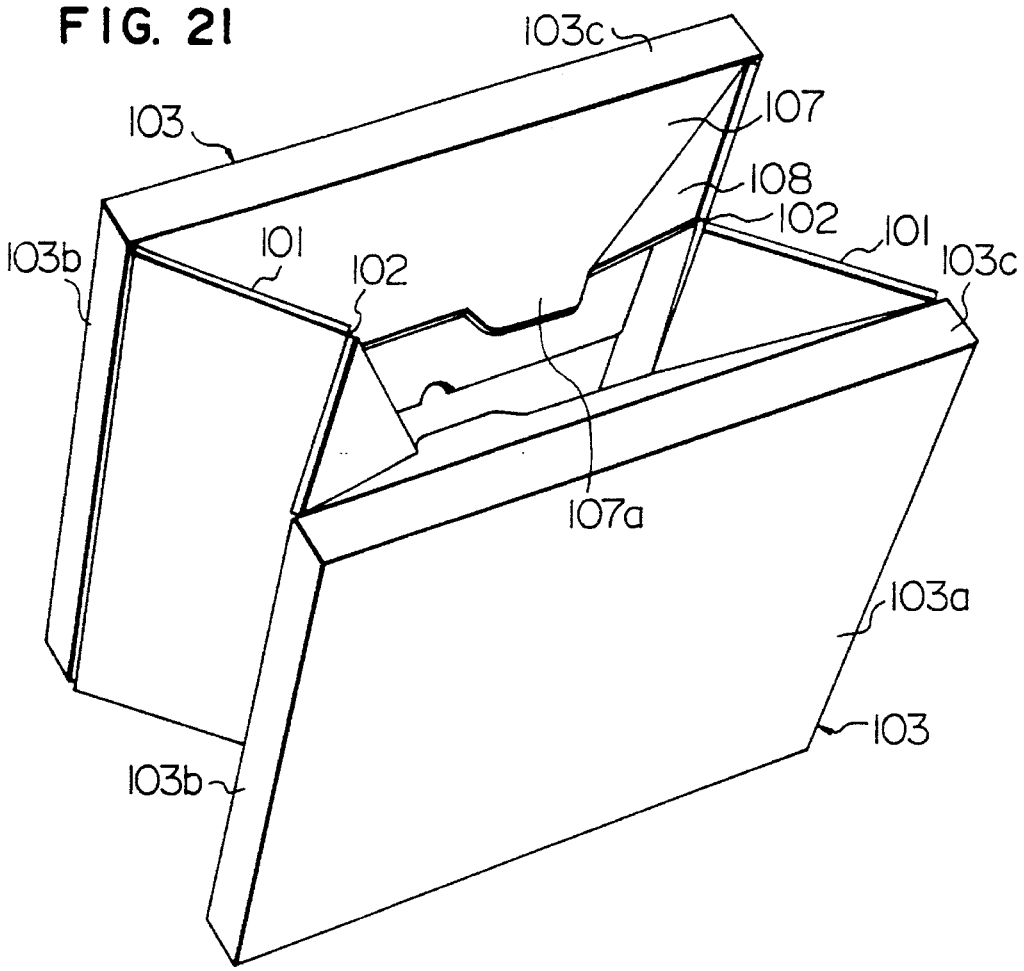
FIG. 21 is a view showing the process of folding the box of FIG. 20.
Figure 22:
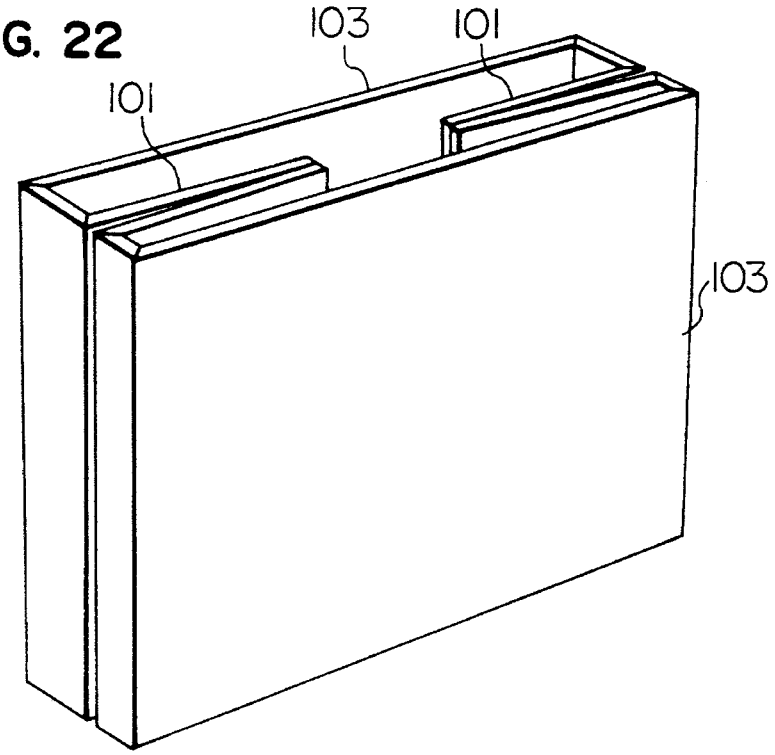
FIG. 22 is a view showing the box of FIG. 20 in its folded condition.

A further modified folding box of the invention will now be described with reference to FIGS. 20 to 23. FIG. 20 shows the box in its assembled condition, FIG. 21 is a view as seen from the bottom side of the box in the process of folding the box, and FIG. 22 shows the box in its folded condition. As shown in these Figures, the box of this embodiment includes a pair of first side walls 101 each foldable inwardly at a hinge 102 provided at a central portion thereof, a pair of second side walls 103 of a generally U-shaped cross-section integrally connected to the first side walls 1 by hinges 104, as shown in FIG. 20, and a bottom portion connected to the first and second side walls 101 and 103. Each second side wall 103 includes a main wall portion **103*a*, opposite end wall portions 103*b*, and a bottom wall portion 103*c***.

Figure 23:
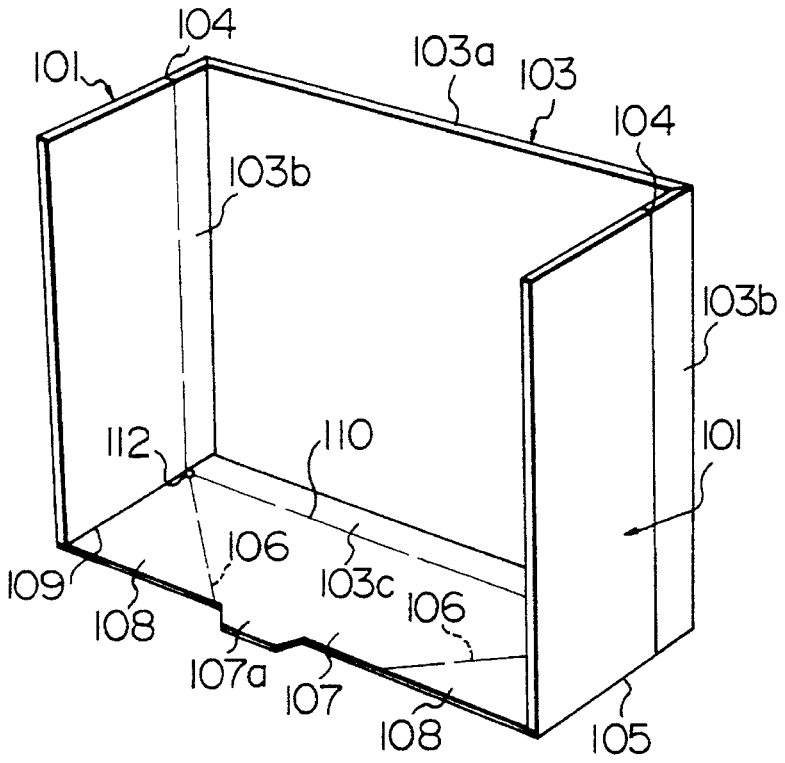
FIG. 23 is a perspective view of a portion of the box of FIG. 20.

FIG. 23 shows a portion of the box, showing the inside of the box and the bottom portion. The bottom portion is constituted by a pair of bottom plates 105, and each bottom plate 105 includes a trapezoidal portion 107 and a pair of triangular portions 108, and the boundary between the trapezoidal portion 107 and each triangular portion 108 defines a folding line 106. Each triangular portion 108 can be turned inwardly at a connection portion 109 at which the triangular portion 108 is connected to the foldable first side wall 101, and the trapezoidal portion 107 can be turned inwardly at a connection portion 110 at which the trapezoidal portion 107 is connected to the bottom wall portion **103*c* of the second side wall 103. Two structural members shown in FIG. 23 are connected together to form the box shown in FIG. 20 in such a manner that each first side wall 101 can be folded at the hinge 102. The bottom plate 105 has an engagement portion 107***a* formed on the edge of the trapezoidal portion 107 remote from the second side wall 103. In the assembled condition of the box as shown in FIG. 20, the pair of bottom plates 105 are engaged with each other at their engagement portions 107*a* to jointly provide the bottom of the box.

With this construction, simultaneously when each first side wall 101 is folded at the central hinge 102, the triangular portions 108 and the trapezoidal portion 107 of each bottom plate 105 are turned inwardly, so that the box is folded as shown in FIG. 22.

Namely, two structural members shown in FIG. 23 are first placed in opposed relation to each other with their insides directed toward each other, and are integrally connected together by the hinges 102 to form the box shown in FIG. 20. For folding the box, each foldable first side walls 101 is inwardly folded at the hinges 102, and at the same time each bottom plate 105 is inwardly folded at the folding lines 106, so that the box is brought into the folded condition (FIG. 22) through the half-folded condition (FIG. 21). In this embodiment, a reinforcement bottom plate 111 is pivotally mounted at its lower edge 111*a* on the lower edge of one second side wall 103. Therefore, when the box is to be folded, this reinforcement bottom plate 111 is first pivotally moved into a generally upright condition. A finger-engagement dent 111*b* is formed in the distal edge of the reinforcement bottom plate 111.

In this embodiment, the first and second side walls 101 and 103 are made of a corrugated board, a thin synthetic resin sheet or the like, and have a predetermined thickness. Each of the bottom plates 105 is made of a relatively thin, flexible material so that the box can be easily folded, and the bottom plate 105 has the above-mentioned construction so as to be folded. Therefore, the reinforcement bottom plate 111 is used to reinforce the strength of the bottom plates 105.

In this embodiment, the first and second side walls and the reinforcement bottom plate are made of a relatively thick board or a thin synthetic resin sheet, and each bottom plate 105 is made of a relatively thin flexible sheet. When the box is to be folded, the two bottom plates 105 are separated from each other, and folded in such a manner as to form a space between the two bottom plates 105 as shown in FIG. 21, and with this arrangement, the box can be folded. A small hole 112 serving as a wrinkle-absorbing portion is formed in that portion of the box where the bottom plate 105, the first side wall 101 and the second side wall 103 are joined together. With this arrangement, the box can be folded more easily. A preferred form of the wrinkle-absorbing portion is a preformed wrinkle portion which can be deformed to a larger extent. In this embodiment, the bottom plate 105 is made of a relatively thin flexible material so as to be folded, and therefore may fail to withstand a heavy weight of an article held in the box. Furthermore, when an external force is applied to the bottom plate 105, there is a possibility that the bottom plate 105 is lifted to fold the box. To overcome this difficulty, in this embodiment, the reinforcement bottom plate 111 is provided. The reinforcement bottom plate 111 also serves to increase the strength of the box, so that the box will not be easily deformed upon application of an external force. Each second side wall 103 has the four faces defined respectively by the main wall portion 103*a*, the two end wall portions 103*b* and the bottom wall portion 103*c*, and all of the corners of the second side wall 103 are right-angular or perpendicular. Therefore, the second side wall 103 has an increased strength. More specifically, the bottom face is integrally joined perpendicularly to the three side faces, thereby providing an extremely increased strength.

In this embodiment, the end wall portions 103*b* of the two second side walls 103 are different in width. More specifically, the opposite end wall portions 103*b* of one second side wall 103 to which the reinforcement bottom plate 111 is pivotally connected have a greater width. With this arrangement, when the box is folded, the reinforcement bottom plate 111 can be readily received in this second side wall 103. This arrangement is advantageous particularly when the reinforcement bottom plate 111 is thick. The end wall portions 103*b* of the two second side walls 103 may be equal in width.

Figure 24:
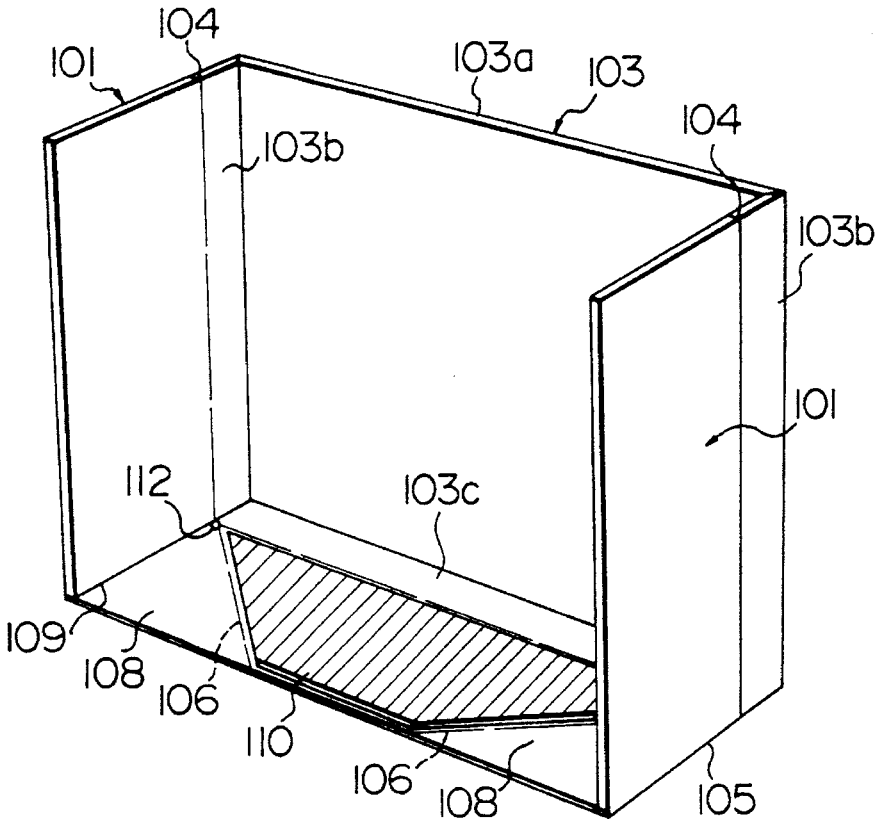
FIG. 24 is a perspective view of a portion of a further modified box.

FIG. 24 shows a half of a further modified box in which the strength of a bottom plate is increased. In this embodiment, a trapezoidal thick sheet 110 substantially equal in size to a trapezoidal portion 107 of the bottom plate 105 is affixed to the trapezoidal portion 107 to reinforce the same. With this arrangement, although the flexibility of the trapezoidal portion 107 is lost, the bottom plate 105 can still be folded since a pair of triangular portions 108 are flexible.

Naturally, the trapezoidal thick sheet 110 is affixed to the bottom plate 105 in such a manner that the bottom plate 105 can be folded at folding lines 106.

Figure 25:
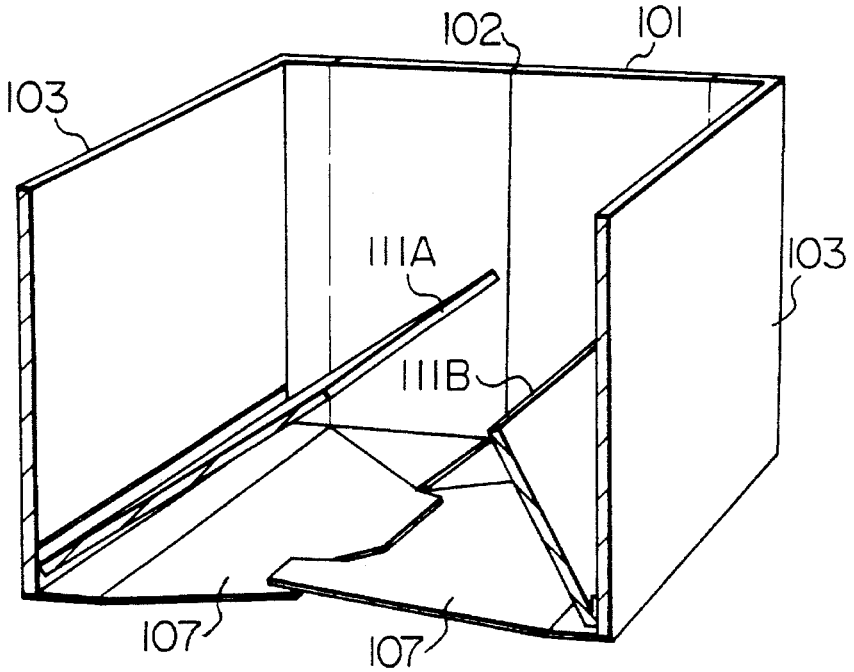
FIG. 25 is a partly-broken, perspective view of a further modified box with two reinforcement bottom plates.

FIG. 25 shows a further modified box in which a pair of reinforcement bottom plates 111A and 111B are used, one plate 111A being wider than the other plate 111B. The reinforcement bottom plates 111A and 111B are abutted at their distal ends or edges against each other when they are laid flat against bottom plates 105. The wider reinforcement bottom plate 111A holds those portions of the two bottom plates 105 engaged with each other, thereby preventing the two bottom plates 105 from becoming disengaged from each other, and the reinforcement bottom plates 111A and 111B reinforce the bottom of the box. The two reinforcement bottom plates 111A and 111B, like the single reinforcement bottom plate 111 of FIG. 20, are pivotally connected at their one ends respectively to two second side walls 103 by an adhesive or other suitable means.

Figure 26A:
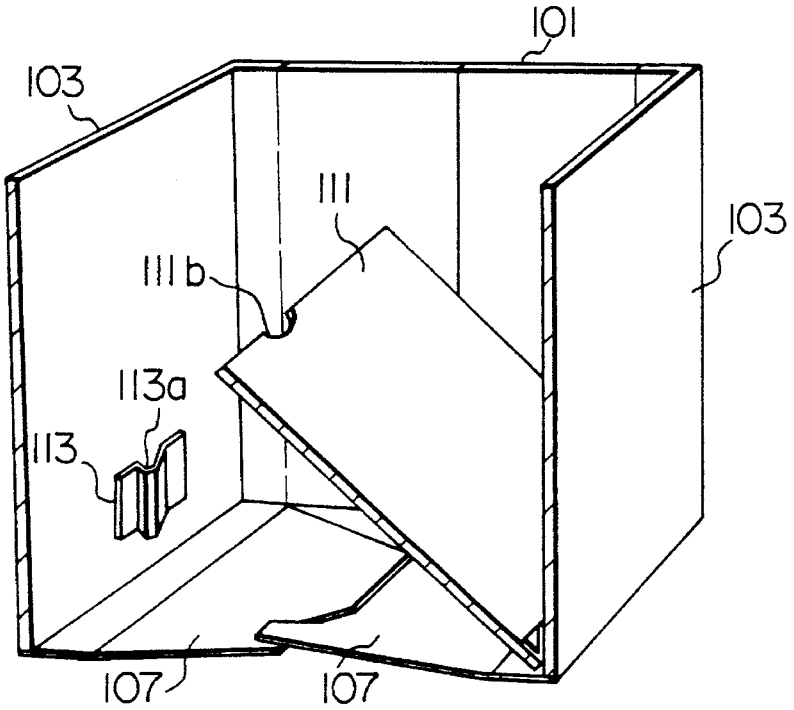
FIGS. 26A to 26C are views of a further modified box.
Figure 26B:
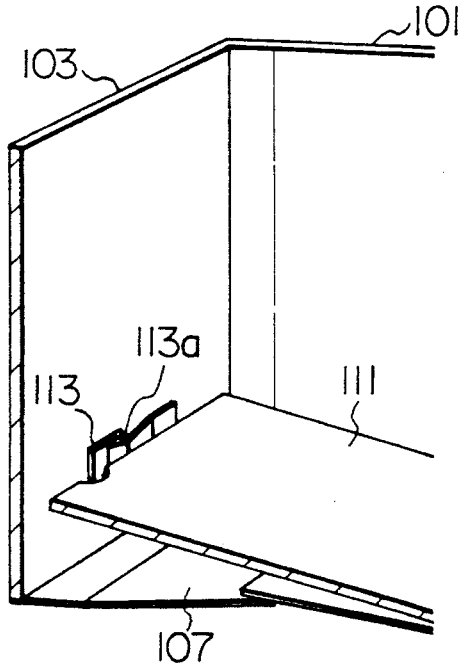
Figure 26C:
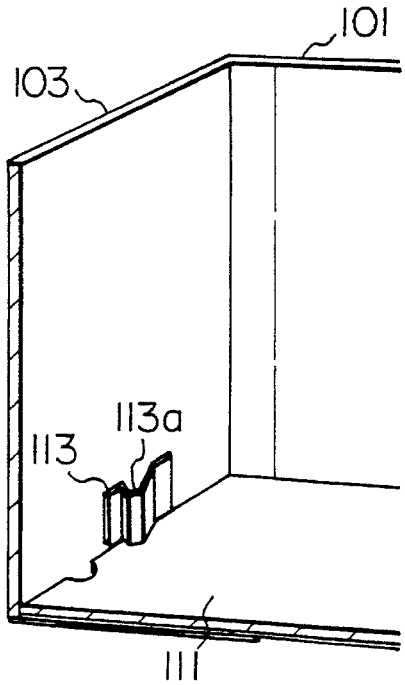

FIGS. 26A–C show a modified form of the box of FIG. 20, and in this embodiment a retaining portion 113 is provided on the second side wall 103. By virtue of the provision of the retaining portion 113, the reinforcement bottom plate 111 is prevented from moving away from the bottom plate 105 when the assembled box is in use. Also, even when an external force is applied to the bottom plates 105 from the lower side, the reinforcement bottom plate 111 is prevented from being lifted, thereby preventing the bottom plates 105 from being folded.

As shown in FIGS. 26A–C, the retaining portion 113 has a deformable projection 113*a* at its central portion. The retaining portion 113 is fixedly secured to the second side wall 103 in such a manner that the lower end of the retaining portion 113 is disposed at a level substantially equal to the upper surface of the reinforcement bottom plate 111 when this bottom plate 111 is laid flat against the bottom plates 105. The length of the retaining portion 113 in the vertical direction is suitably determined. With this arrangement, the retaining portion 113 can retain the reinforcement bottom plate 111, as shown in FIGS. 26A, 26B and 26C. More specifically, the reinforcement bottom plate 111 is pivotally moved downward toward the bottom plates 115 as shown in FIG. 26A. During this downward movement, the reinforcement bottom plate 111 is inclined relative to the bottom plates 105, and therefore its distal end is spaced from the second side wall 103 having the retaining portion 103 secured thereto. Therefore, before the reinforcement bottom plate 111 is brought into engagement with the retaining portion 113 as shown in FIG. 26B, the reinforcement bottom plate 111 can pivotally move downward without being obstructed by the projection 113*a* of the retaining portion 113. Then, the reinforcement bottom plate 111 further moves downward, urging and deforming the projection 113*a*, so that the upper surface of the reinforcement bottom plate 111 is brought into a position slightly below the lower end of the retaining portion 113, as shown in FIG. 26C. As a result, the projection 113*a* is returned to its initial configuration by its own restoring force, thereby retraining the reinforcement bottom plate 111 against upward movement.

For folding the box of this embodiment, the projection 113*a* is pressed to bring the retaining portion 113 into a generally flat configuration, and then the reinforcement bottom plate 111 is pivotally moved upward using a finger engagement dent 111*b*, thereby releasing the retaining of the reinforcement bottom plate 111, and the box is folded in the same manner as described above for the embodiment of FIG. 20.

Figure 28:
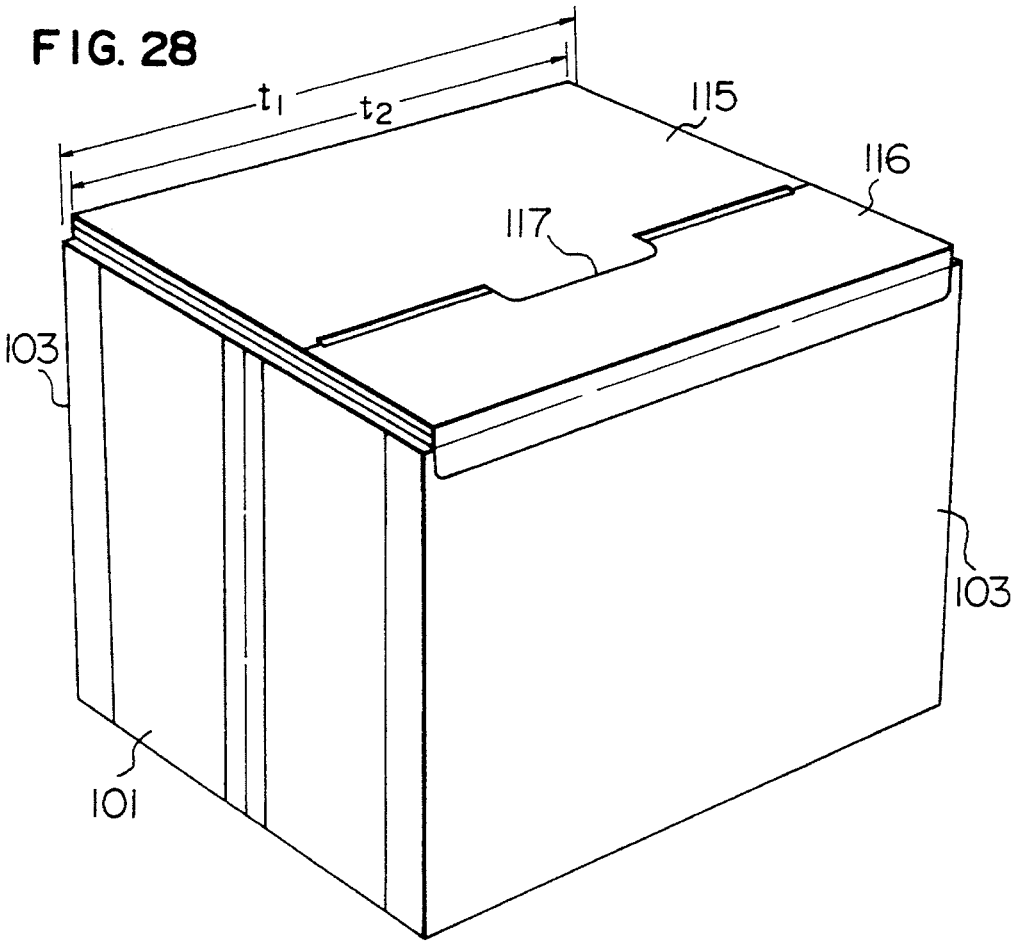
FIG. 28 is a perspective view of the box of FIG. 26, showing lids in their closed positions.
Figure 27:
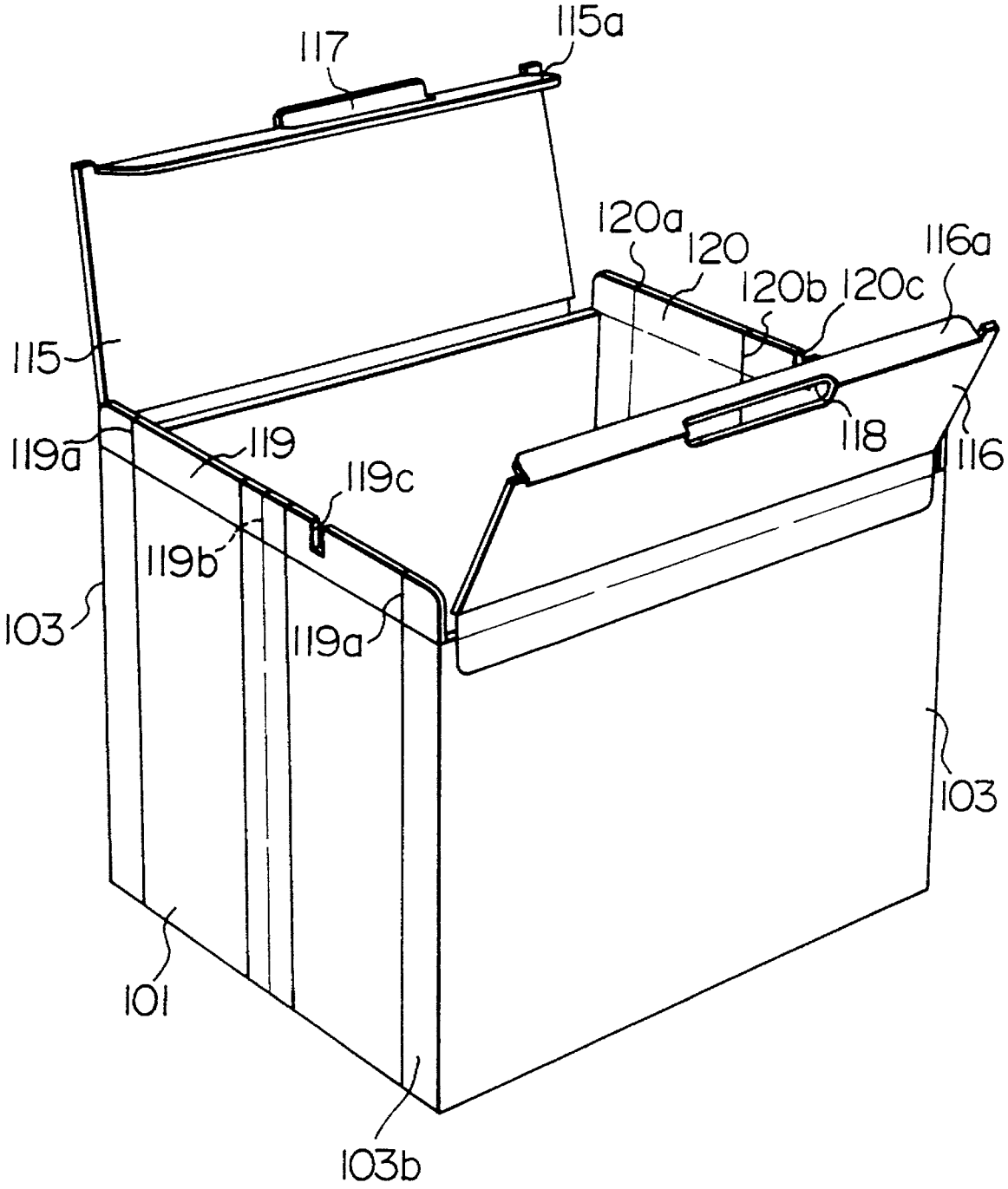
FIG. 27 is a perspective view of the box of FIG. 26.
Figure 29:
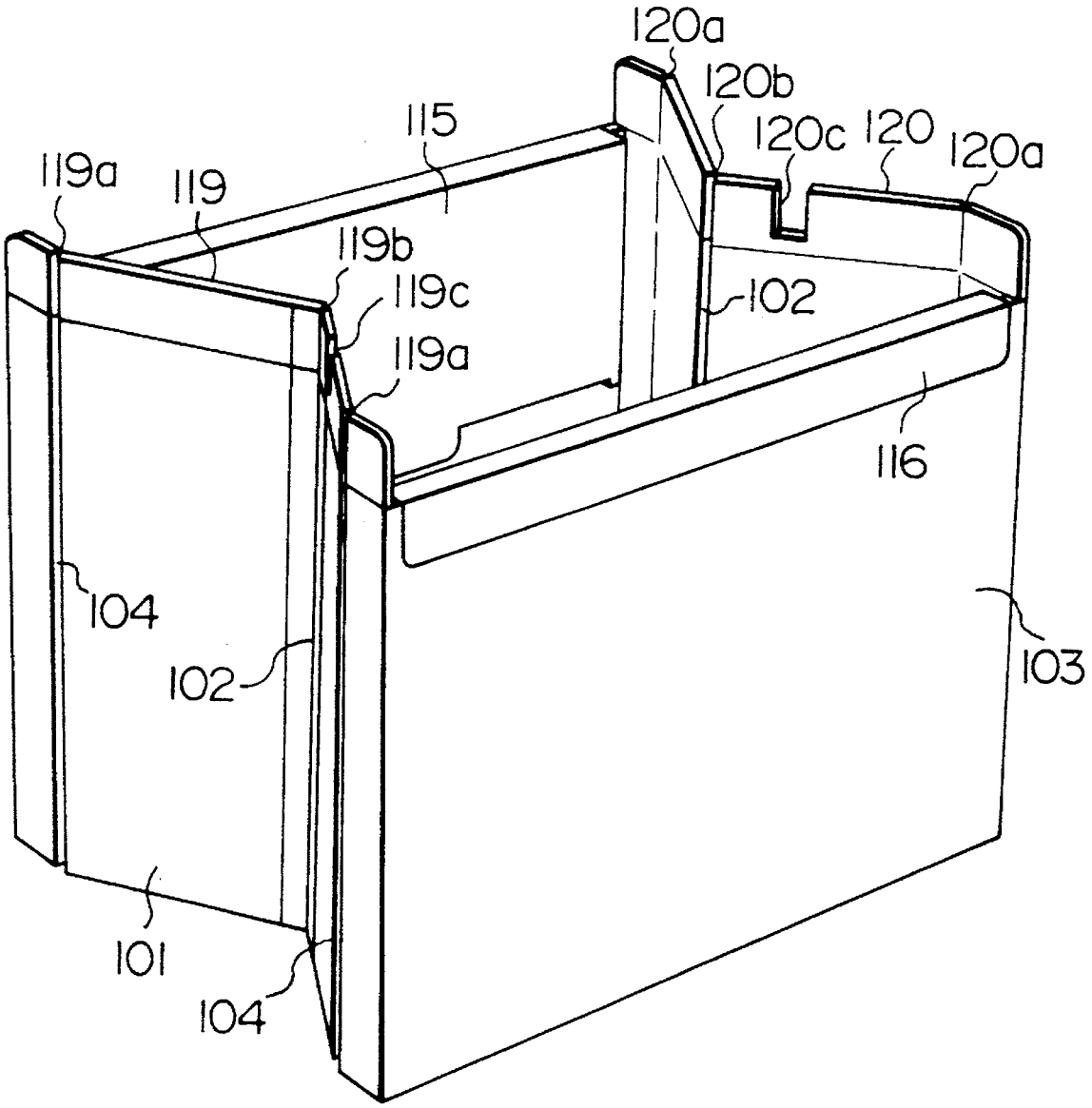
FIG. 29 is a view showing the process of folding the box of FIG. 26.

FIGS. 27, 28 and 29 show a further modified folding box with lids. More specifically, the box has two lids 115 and 116 different in width from each other. The wider lid 115 has a retaining piece 117, and the narrower lid 116 has a slot 118. The lids 115 and 116 have tuck flaps 115*a* and 116*a* at their distal ends, respectively. The widths of the two lids 115 and 116 are so determined that when the lids 115 and 116 are in their closed positions, the tuck flaps 115*a* and 116*a* are held in contact with each other. A pair of flaps 119 and 120 extend upwardly respectively from upper edges of opposite side walls of the box which are defined by first side walls 101 and opposite end wall portions 103*b* of second side walls 103. Each of the flaps 119 and 120 is foldable at its central portion 119*b*, 120*b* and at its opposite end portions 119*a*, 120*a* each disposed in registry with the boundary between the first side wall 101 and the end wall portions 103*b* of the second side wall 103. Each of the flaps 119 and 120 has a groove 119*c*, 120*c* at a portion thereof disposed in registry with the position where the tuck flaps 115*a* and 116*b* are held against each other in the closed condition of the lids 115 and 116. The other construction of this box is the same as that of the embodiment of FIG. 20.

In this embodiment, the flaps 119 and 120 are turned inwardly, and the lids 115 and 116 are closed, so that the tuck flaps 115*a* and 116*a* are inserted into the grooves 119*c* and 120*c*, and also the retaining piece 117 is inserted into the slot 118, as shown in FIG. 28. For folding the box, the retaining piece 117 is removed from the slot 118, and the two lids 115 and 116 are opened, and then are turned into the box, and then the box can be folded in the same manner as described above for the embodiment of FIG. 20.

In this embodiment, the length $t_2$ (FIG. 28) of each of the lids 115 and 116 is equal to or smaller than the length $t_1$ of the second side wall 103.

Figure 30:
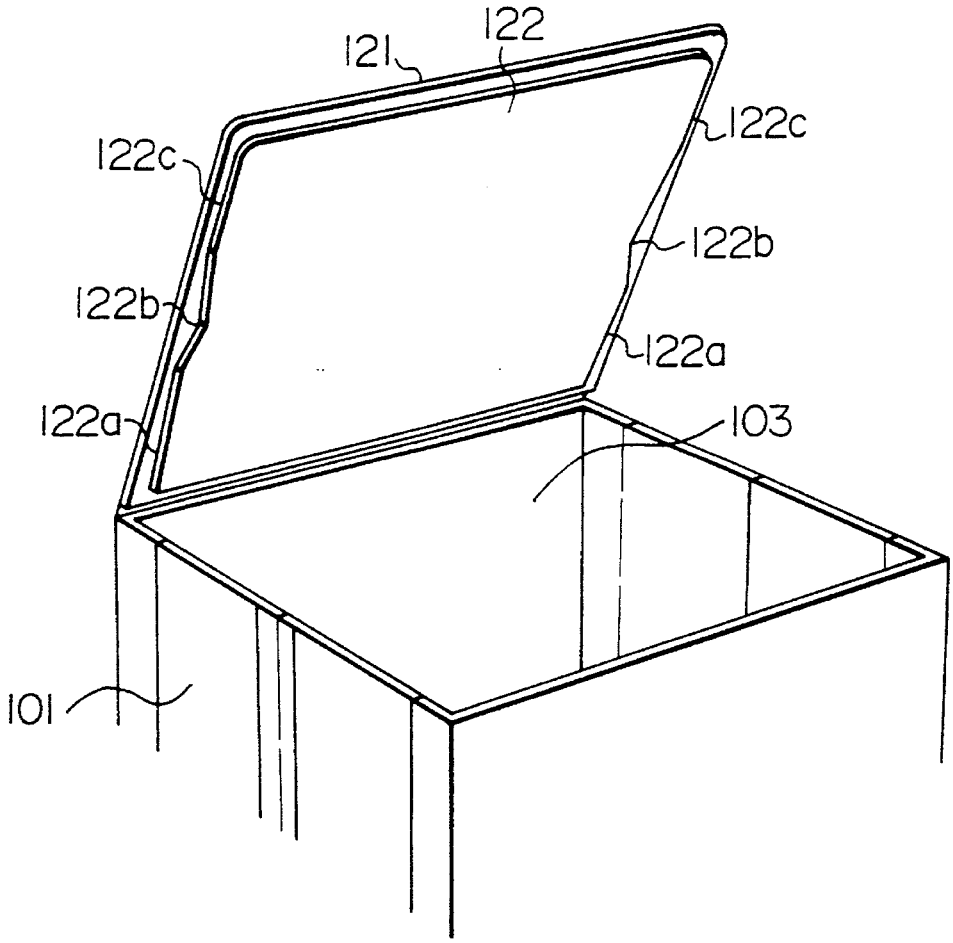
FIG. 30 is a view showing a portion of a further modified box.

FIG. 30 shows a further modified box having a single lid. In this embodiment, the lid 121 is pivotally connected at one end to an upper edge of one second side wall 103. A retaining plate 122 is mounted on a reverse side of the lid 121. When the lid 121 is closed, the retaining plate 122 is received in the box, and part of opposite side edges of the retaining plate 122 are pressed against a pair of opposed first side walls 101, respectively, thereby preventing the lid 121 from being accidentally opened. The retaining plate 122 also serves to increase the strength of the lid 121.

Figure 31:
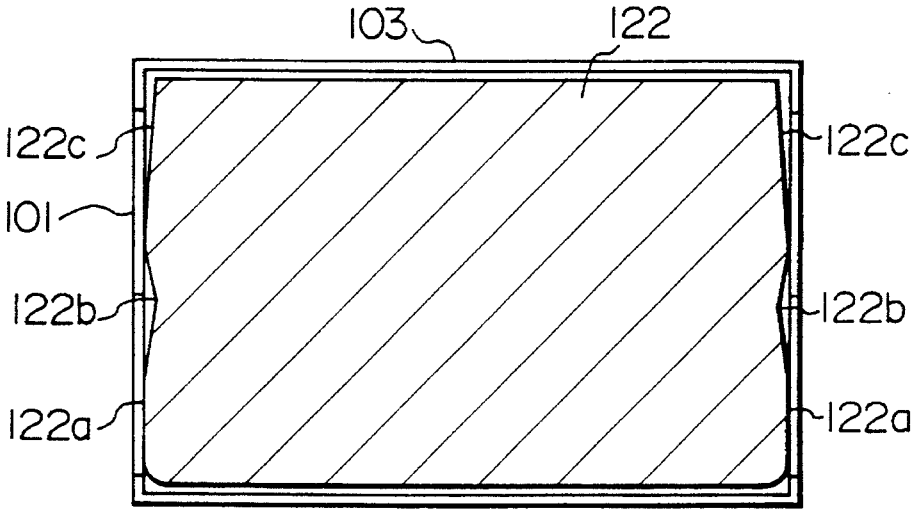
FIG. 31 is a view showing the inside of a lid used in the box of FIG. 30.
Figure 32:
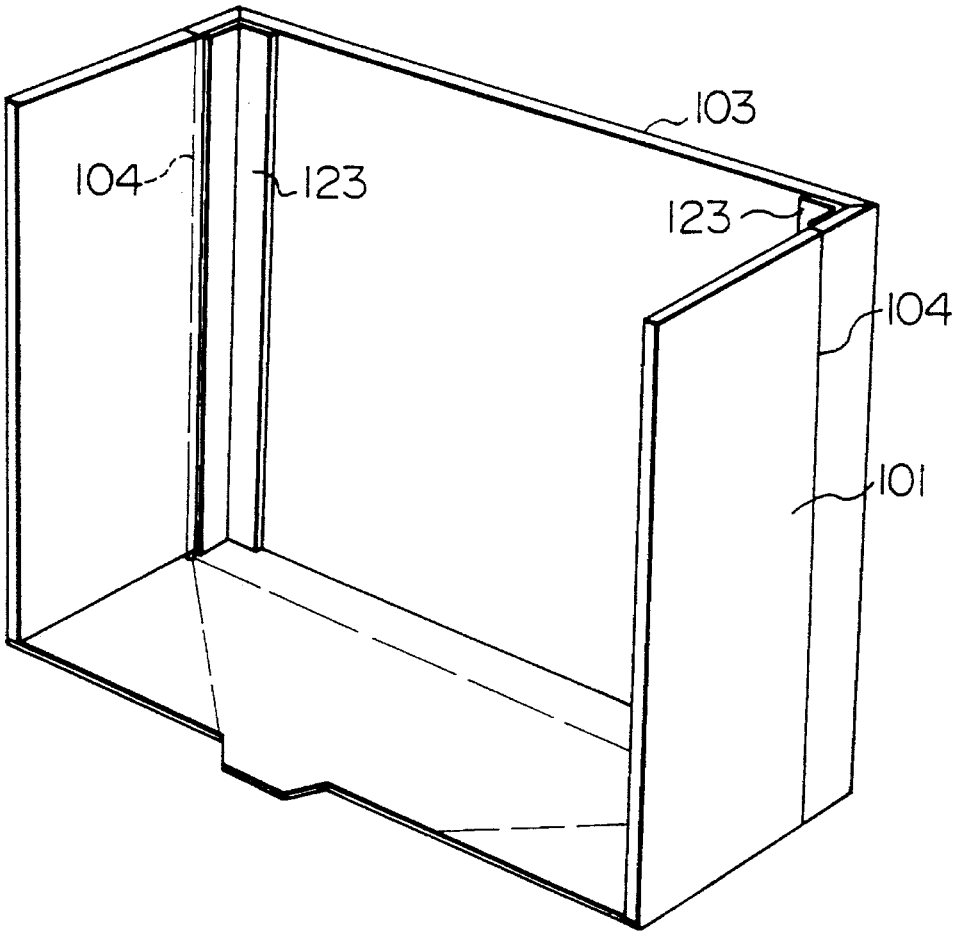
FIG. 32 is a view showing corner reinforcement means for the box of the invention.

FIG. 31 shows the relation between the retaining plate 122 and the first and second side walls 101 and 103 in the closed condition of the lid 121. As shown in FIG. 31, front end portions 122*a* of the opposite side edges of the retaining plate 122 respectively urge the two first side walls 101 away from each other to slightly increase the distance therebetween, and are frictionally engaged respectively with the two first side walls 101, thereby retaining the retaining plate 122 and hence the lid 122. Those portions of the retaining plate 122 to be pressed against the first side walls 101 are not limited to the above portions 122*a*; however, a central portion 122*b* of each side edge of the retaining plate 122 should be recessed to be spaced from the first side wall 101, since a hinge 102 on the first side wall 101 is disposed in contiguous relation to this central portion 122*b* in the closed position of the lid 121.

Thus, in the embodiment of FIGS. 30 and 31, when the lid 121 is closed, the lid 121 is retained in this closed position through the retaining plate 122, and the lid 121 will not be accidentally opened. In this case, the distance between the two first side walls 101 can be slightly increased, and therefore the portions 122*a* of the retaining plate 122 can be easily received in the box. When the retaining plate 122 is received in the box, it urges the two first side walls 101 outwardly away from each other, so that the lid 121 will not be accidentally opened. For folding the box, the lid 121 is opened and is further turned in the reverse direction, and then the box is folded in the same manner as described above for the embodiment of FIG. 20.

Preferably, proximal end portions 122*c* of the opposite side edges of the retaining plate 122 adjacent to the proximal end thereof at which the retaining plate 122 is pivotally connected to the second side wall 103 are slanting in such a manner that the width of the retaining plate 122 between the proximal end portions 122*c* is increasing progressively toward the central portions 122*b*, as shown in FIG. 31.

With this configuration of the retaining plate 122 as shown in FIG. 31 (plan view), when the lid 121 is to be closed, the retaining plate 122 is first brought into contact with the two first side walls 101 at the portions 122*c* thereof, and these slanting portions 122*c* expand the box, that is, urge the two first side walls 101 away from each other. This enables the lid 121 to be closed more smoothly. And besides, when the lid 121 is completely closed, the lid 121 is retained and held in the closed condition by the retaining plate 122. Moreover, since the width of the retaining plate 122 between the central portions 122*b* to be brought respectively into facing relation to the hinges 102 of the first side walls 101 is reduced, the lid 121 can be closed easily.

In the above embodiments, the second side wall 103 can be constituted by a main wall portion 103*a* and opposite end wall portions 103*b* which are separate from the main wall portion 103*a*, and are joined thereto by an adhesive. In this case, the corner portions of the second side wall 103 may be weak. For example, when the boxes are stacked one upon another, the angle of the corner portion may become larger or smaller than 90 degrees because of the load, and the strength is reduced. To avoid this, a reinforcement member 123 is bonded to each corner portion of the second side wall 103 by an adhesive or the like, thereby increasing a load-withstanding property. The reinforcement member 123 is preferably a cardboard of an L-shaped cross-section, but may be made of a film or the like.

Figure 33:
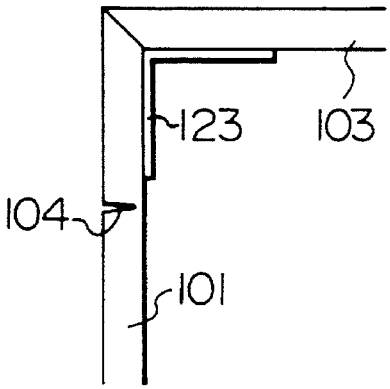
FIG. 33 is a top plan view of a corner portion of the box of FIG. 30.
Figure 34A:
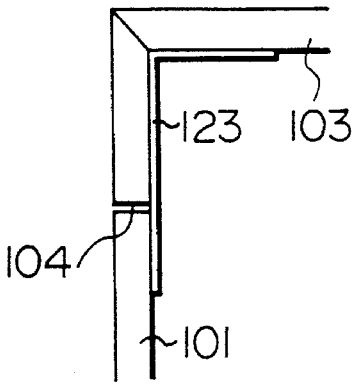
FIGS. 34A and 34B are views showing another corner reinforcement means.
Figure 34B:
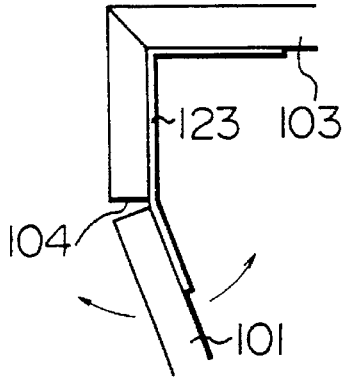

FIGS. 33 and 34A and B show those portions of the box where the reinforcement member 123 is provided. In FIG. 33, the reinforcement member 123 is applied only to the corner portion. In FIGS. 34A and B, the reinforcement member 123 is applied to the corner portion, and also extends to cover the hinge portion including the hinge 104, thus reinforcing both of the corner portion and the hinge portion. In the case of the structure of FIGS. 34A and B, the first side wall 101 and the second side wall 103 may be separate from each other, and may be hingedly connected together only by the reinforcement member 123.

Figure 35:
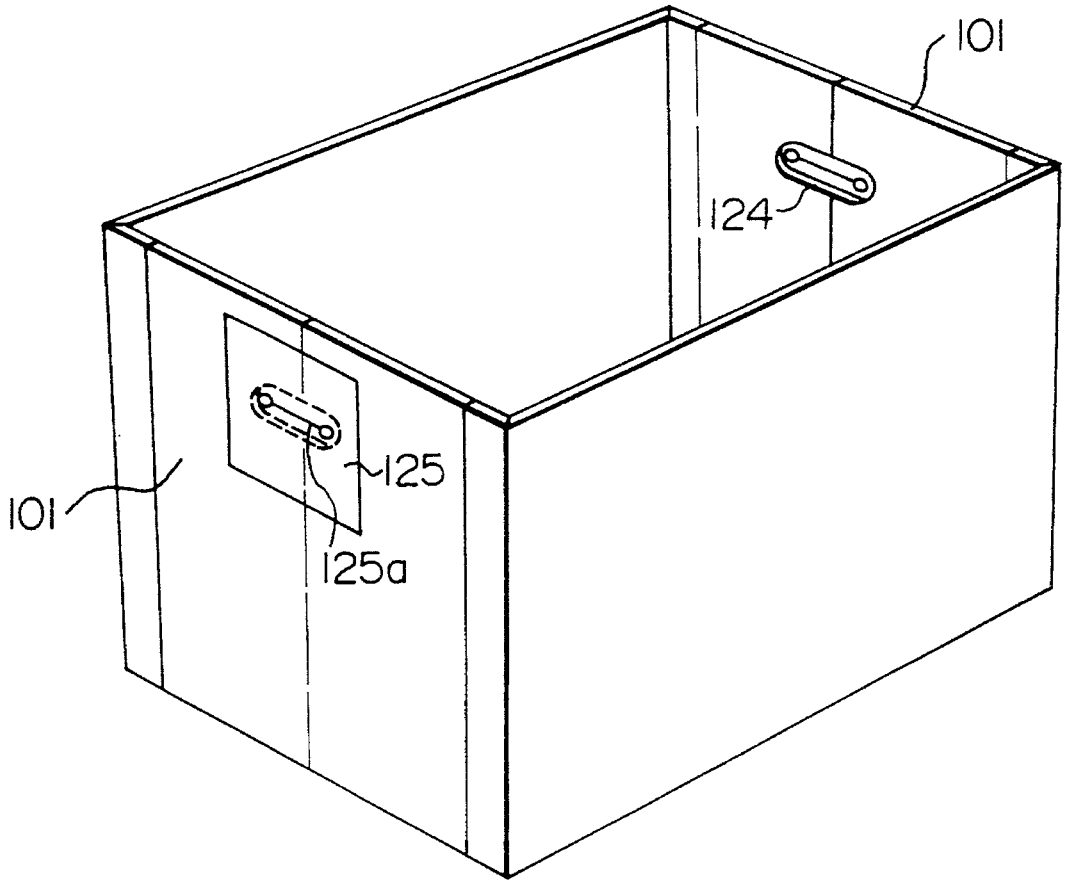
FIG. 35 is a view of a further modified box having handgrips.
Figure 36A:
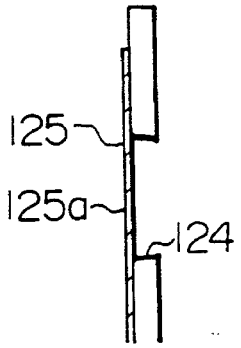
FIGS. 36A and 36B are cross-sectional views showing the handgrips of FIG. 35.
Figure 36B:
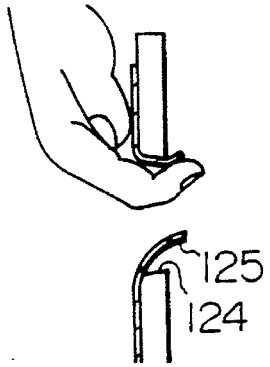

FIGS. 35 and 36A and B show a further modified box. A pair of handgrip holes 124 are formed through two first side walls 101, respectively so that the box can be easily held and carried. When the hole 124 of the illustrated configuration is formed by punching, the hand may be injured by burrs on the edge of the handgrip hole 124. Therefore, in this embodiment, a flexible film 125 of paper, a resin or the like is bonded to the outer surface of the first side wall 101 to cover the handgrip hole 124, the film 125 having a slit 125*a*. When the hand is inserted into the slit 125*a* in the film 125, and holds the handgrip 124, the hand is protected by the film 125, as shown FIG. 36B. It is not always necessary to provide the slit 125*a* in the film 125, in which case the film 125 is broken or torn by inserting the hand into the handgrip hole 124 through the film 125. The film 125 is bonded to that portion of the first side wall 101 at which a hinge 102 is provided, and therefore the film 125 also serves to reinforce the hinge portion 102.

Figure 37:
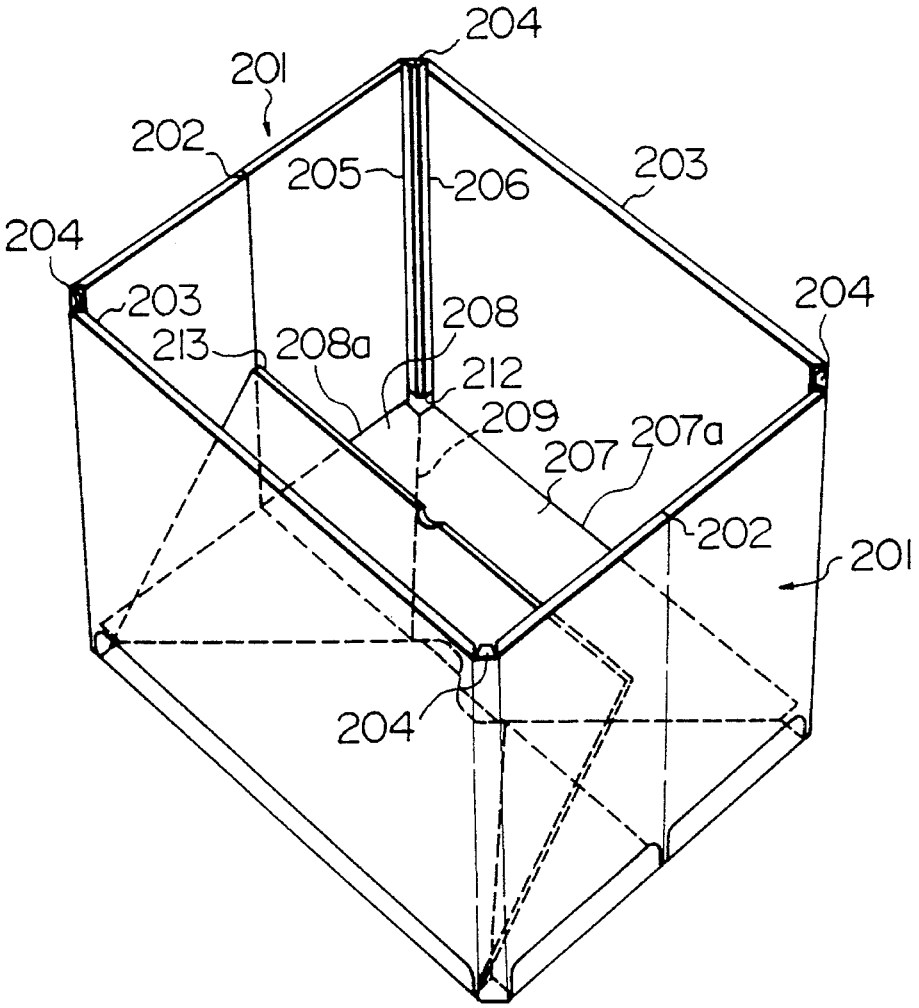
FIG. 37, is a perspective view of a further modified box in an assembled condition.
Figure 38:
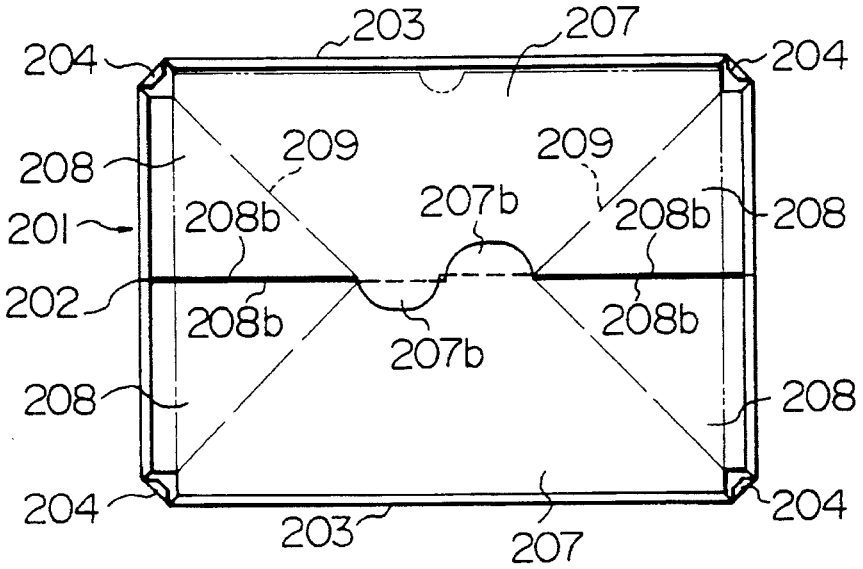
FIG. 38 is a top plan view of the box of FIG. 37 in the assembled condition.
Figure 39:
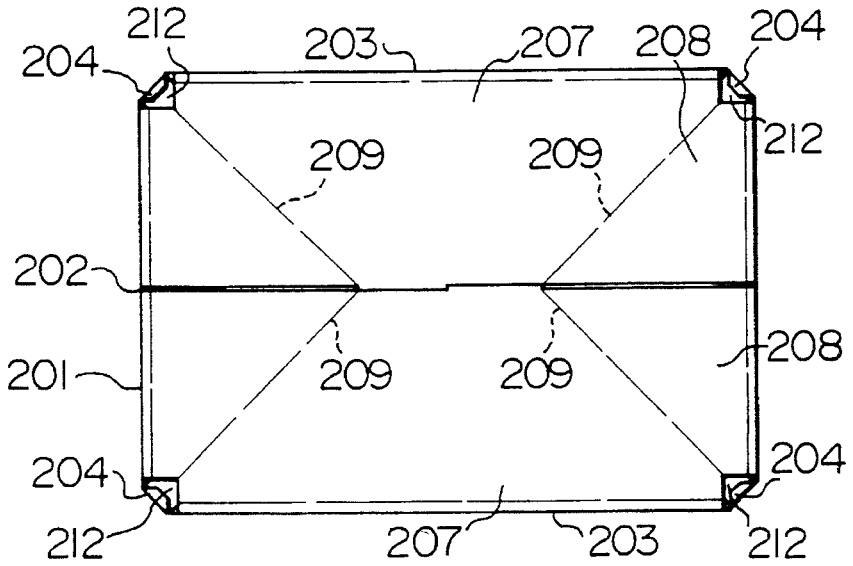
FIG. 39 is a bottom view of the box of FIG. 37 in the assembled condition.
Figure 40:
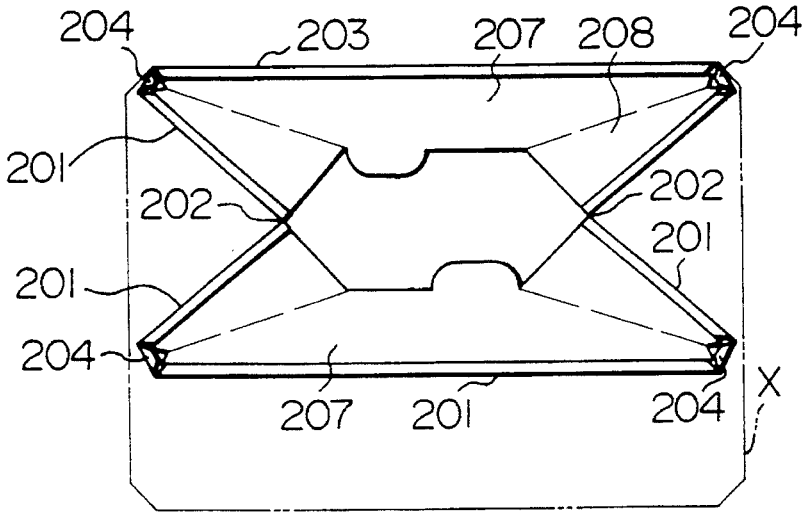
FIG. 40 is a top plan view of the box of FIG. 37 during the folding operation.
Figure 41:
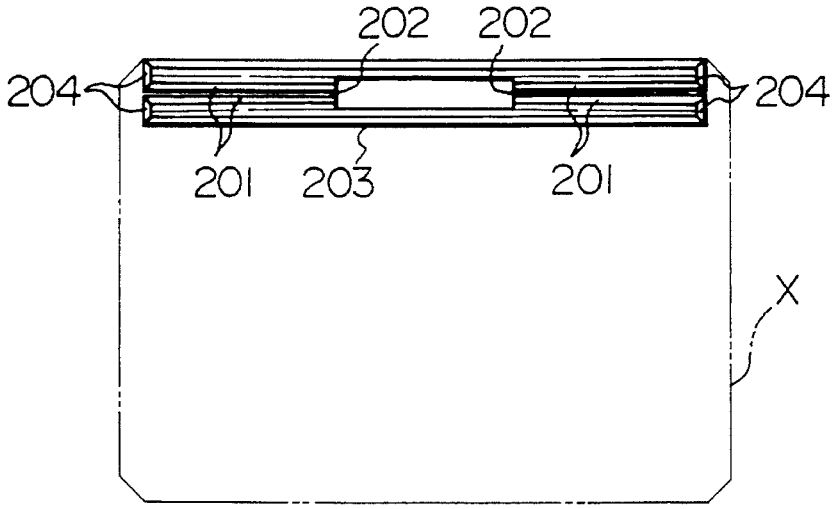
FIG. 41 is a top plan view of the box of FIG. 37 in the folded condition.

FIGS. 37 to 41 shows a further modified box. FIG. 37 is a perspective view of the box in its assembled condition, FIG. 38 is a top plan view of the box in the assembled condition, and FIG. 39 is a bottom view of the box. FIG. 40 is a view showing the box during the folding operation, and FIG. 41 shows the box in its folded condition.

As shown in these FIGS. 37 to 41, the box of this embodiment comprises a pair of opposed first side walls 201 each foldable inwardly at a hinge 202 provided at a central portion thereof, and a pair of opposed second side walls 203 disposed adjacent to the first side walls 201. The adjacent first and second side walls 201 and 203 are connected together through a vertically-elongate connection member 204 so as to be turned at hinges 205 and 206. The bottom of the box is constituted by a pair of bottom plates each including a trapezoidal portion 207 and right-angled triangular portions 208. The boundary between each right-angled triangular portion 108 and the trapezoidal portion 207 defines a folding line 209, and the bottom plate is inwardly foldable at the folding lines 209. The trapezoidal portion 207 is hingedly connected at its longer side 207*a* to the second side wall 203 so as to be turned inwardly. One side of the right-angled triangular portion 208 is connected to the trapezoidal portion 207 along the folding line 209 so as to be turned inwardly, and another side 208*a* of the triangular portion 208 is connected to the lower edge of a half of the first side wall 201 lying between the second side wall 203 and the central hinge 202, so that the right-angled triangular portion 208 can be turned inwardly. The shorter sides of the two trapezoidal portions 207 are engageable with each other. An overlap portion 207*b* is formed on the shorter side of each trapezoidal portion 207. The overlap portion 207*b* of one trapezoidal portion 207 is adapted to be held against the inner surface of the other trapezoidal portion 207, and the overlap portion 207*b* of the other trapezoidal portion 207 is adapted to be held against the inner surface of the one trapezoidal portion 207, so that each overlap potion 207*b* can not easily be disengaged from the mating trapezoidal portion 207. Holes 212 enable the bottom plates and the associated portions to be folded, as later described. A reinforcement plate 213 is pivotally connected at its one end to the lower edge of one second side wall 203.

An overlap portion similar to the overlap portion 207*b* of the trapezoidal portion 207 may be formed on the side 208*b* of each right-angled triangular portion 208 engageable with the side 208*b* of the mating triangular portion 208. With this arrangement, the overlap portions of the adjacent triangular portions 208 are engaged with their mating triangular portions 208, respectively. With this construction, the overlap portions 207 of the trapezoidal portions 207 and the overlap portions of the right-angled triangular portions 208 engage their respective mating portions generally along the entire. Length of the linear boundary between the two bottom plates (where the right triangular portions 208 engage each other, the trapezoidal portions 207 engages each other, and the left triangular portions 208 engage each other), that is, along the central line of the bottom of the box. Therefore, even when an external force is applied to the bottom plates from the lower side, the bottom plates will not be lifted, and therefore will not be folded. A retaining piece can be fixed at its opposite end portions to the opposed two trapezoidal portions 207 across the shorter sides of the two trapezoidal portions 207 disposed in contact with each other, and a retaining piece can be fixed at its opposite end portions to the opposed triangular portions 208 across the sides 208*b* thereof disposed in contact with each other. Such a retaining piece may be a thin strap of a strong material. More specifically, one end portion of the retaining piece is fixedly secured to one of the two bottom plates by an adhesive whereas the other end of the retaining piece is fixed to the other bottom plate by a suitable means. Another alternative of the retaining means is an easily-peelable tape which is bonded to each of the above opposed portions of the two bottom plates, thereby connecting the two bottom plates together.

When any one of the above retaining means is used, the use of the reinforcement bottom plate 213 may be omitted; however, it is preferred to use the reinforcement bottom plate 213 since it increases the overall strength of the box.

In this embodiment, the box in the assembled condition (FIG. 37) can be folded as shown in FIG. 41. The method of thus folding this box will now be described.

In the assembled condition (FIG. 37) of the box, first, the reinforcement bottom plate 213 is pivotally moved into a generally upright position to be disposed adjacent to the second side wall 203, and the overlap portions 207*b* are disengaged from the opposed trapezoidal portions 207, respectively, and then each bottom plate is folded at the folding lines 209, so that the trapezoidal portion 207 and the right-angled triangular portions 208 are turned inwardly, and at the same time each first side wall 201 is folded inwardly at the hinge 202. As a result, the box is folded as shown in FIG. 41. A broken line X in FIG. 41 indicates the outer size of the box in the assembled condition (FIG. 37) as viewed from the top of the box.

During the folding operation, the trapezoidal portions 207 and the triangular portions 208 of the two bottom plates are turned inwardly (upwardly), and at the same time the first side walls 201 are folded inwardly, as shown in FIG. 40. Here, thanks to the provision of the holes 212 formed respectively in the four corners of the bottom of the box, the box can be folded even if the first side walls 201, the trapezoidal portions 207 and the right-angled triangular portions 208 are relatively thick.

When the box is further folded from the condition of FIG. 40, each first side wall 201 is completely folded at the hinge 202, so that the two halves of the folded first side wall overlap each other, and at the same time each bottom plate is completely folded, so that the right-angled triangular portions 208 overlap the trapezoidal portion 207, and the first side walls 201 and the second side walls 203 overlap each other. Thus, the box is completely folded as shown in FIG. 41.

Figure 42:
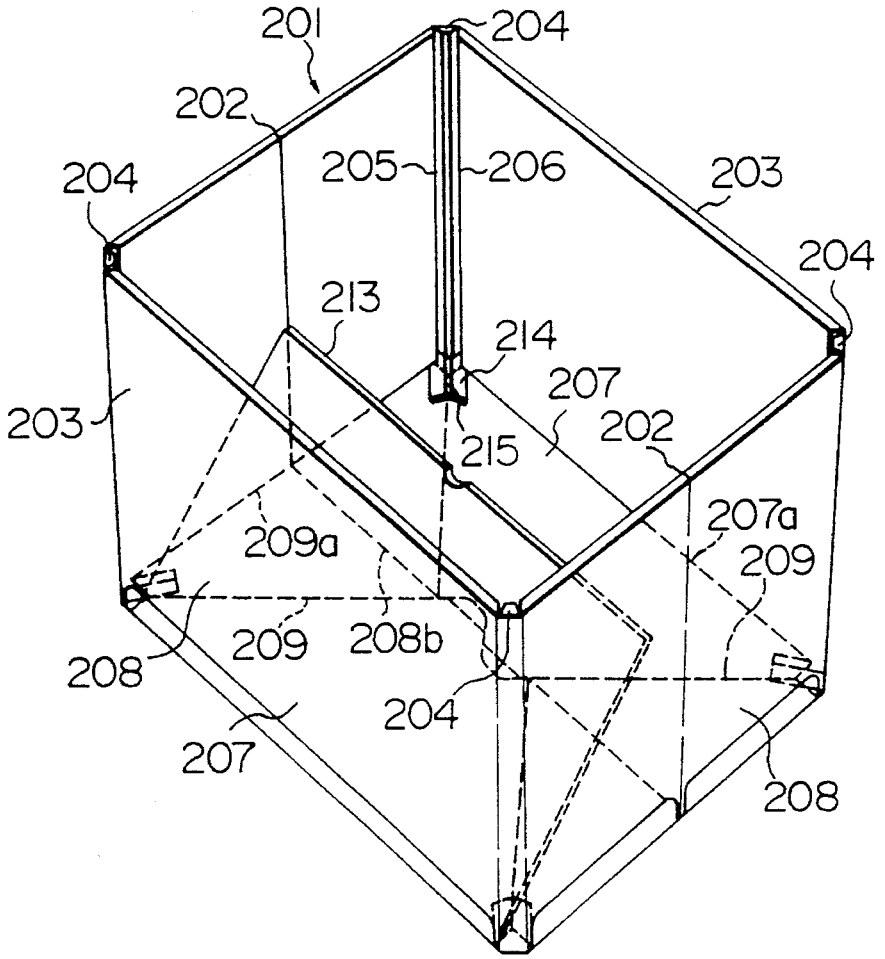
FIG. 42 is a perspective view of the box of FIG. 37 having cover members covering holes formed respectively in four corner portions of the box.

By reversing this operation, the box can be brought from the folded condition (FIG. 41) into the assembled condition (FIG. 37), and the reinforcement bottom plate 213 is laid flat against the bottom plates, thus completing the assembling operation. The holes 212 formed respectively in the four corners need only to be of a small size generally equal to the width of the connection member 204, and the holes 212 will not arouse any problem in so far as articles to be held in the box are not extremely small. Even in such a case, articles of a small size can be safely held in the box if a cover member 214 is applied to each corner portion to cover the hole 212, as shown in FIG. 42. The cover member 214 is foldable as at 215, and therefore will not affect the folding of the box.

Figure 43:
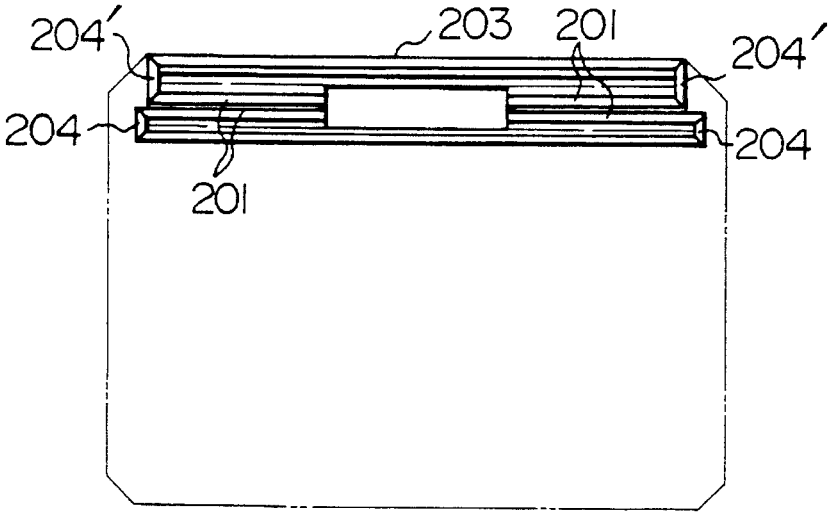
FIG. 43 is a top plan view of a further modified box in a folded condition.

FIG. 43 shows a modified form of the preceding embodiment, in which a connecting member 204 is different in width from a connecting member 204', and opposed second side walls 203 are different in length from each other. FIG. 43 shows the box in its folded condition. As shown in FIG. 43, the area (indicated by a broken line X) of the bottom of the box in the assembled condition is generally equal to that of the box of the preceding embodiment; however, by increasing the width of the connecting member 204', the length of the second side wall 203 can be shortened. Therefore, if the width of all of the connecting members is increased, the length of the folded box is reduced, though the thickness of the folded box is increased.

The box shown in FIG. 37 has no lid, and when such boxes are to be stacked one upon another, a plate must be interposed between the adjacent boxes. A further embodiment of boxes of the invention described in the following can be stacked one upon another although the box has no lid.

Figure 44:
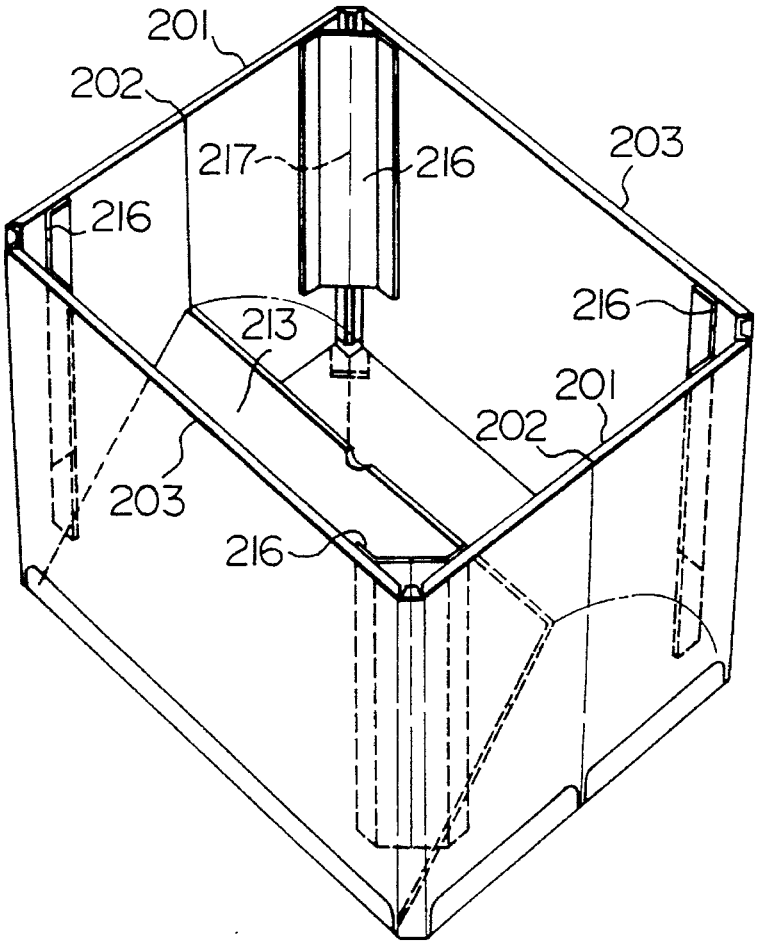
FIG. 44 is a perspective view of a further modified box in an assembled condition.
Figure 45:
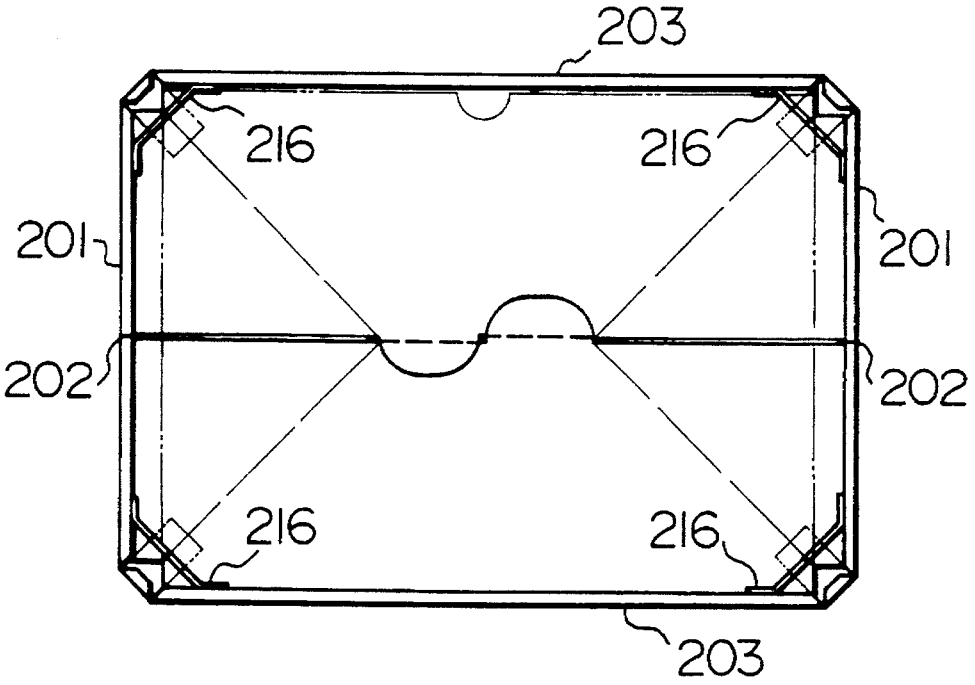
FIG. 45 is a top plan view of the box of FIG. 44 in the assembled condition.
Figure 46:
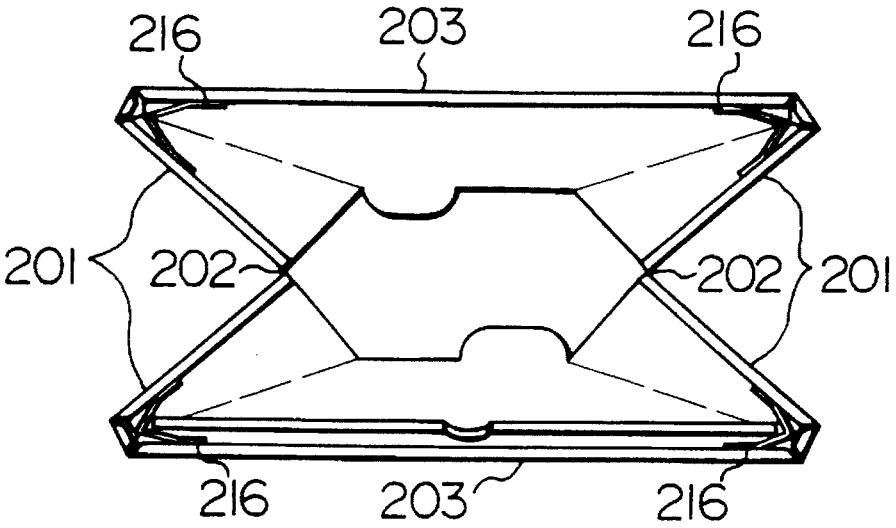
FIG. 46 is a top plan view of the box of FIG. 44 during the folding operation.

FIGS. 44 to 46 show such an embodiment. FIG. 44 is a perspective view of the box in its assembled condition, FIG. 45 is a top plan view of the box in the assembled condition, and FIG. 46 shows the process of folding the box.

In these Figures, first side walls 201, second side walls 203, connection members 204, and bottom plates each including a trapezoidal portion 207 and triangular portions 208 are substantially identical in shape and construction to those of the embodiment of FIG. 37, respectively, and those portions designated by the same reference numerals as those of FIG. 37 have the same constructions and functions, respectively.

In this embodiment, a support portion 216 for stacking purposes is mounted on each corner portion of the box in facing relation to a connection member 204, as best shown in FIGS. 44 and 45. Opposite side edge portions of the support portion 216 are fixedly secured by an adhesive or the like to the first side wall 201 and the second side wall 203, respectively. The support portion 216 is foldable along a center line 217 thereof.

Thanks to the provision of the support portions 216 for stacking purposes, the boxes of this embodiment can be easily stacked one upon another, and besides not only those portions of the box adjacent to the connection members 204 but also the first and second side walls 201 and 203 are reinforced. Therefore, the box has an enhanced load-withstanding property, and has a sufficient strength for the stacking.

The box of this embodiment is folded basically in the manner as described above for the embodiment of FIG. 37, and each support portion 216 will not affect the folding of the box since the support portion 216 is folded in the following manner.

The box is folded in the same manner as described above for the embodiment of FIG. 37, so that the box is brought from the assembled condition (FIGS. 44 and 45) into the condition shown in FIG. 46. Here, each stacking support portion 216 is folded at the folding line 217, and is received in the corner portion. Thus, the support portions 216 do not affect the folding operation, so that the box can be completely folded. As shown in FIG. 44, the support portion 216 does not extend to the bottom of the box, and terminates short of the bottom. This facilitates the pivotal movement of a reinforcement bottom plate 213.

Figure 47A:
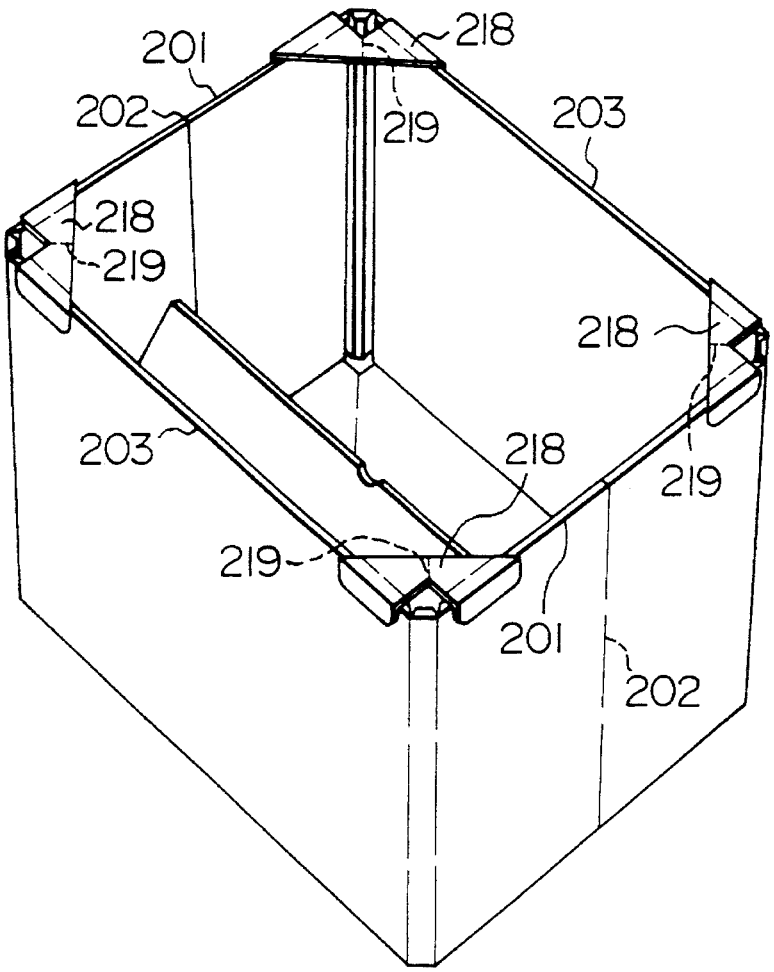
FIGS. 47A and 47B are perspective views of a further modified box in an assembled condition.
Figure 47B:
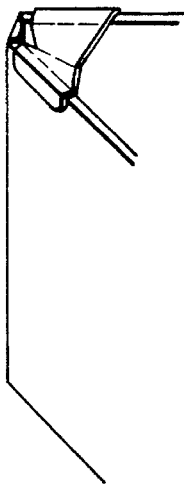

FIG. 47A is a perspective view of a further modified box and FIG. 47B is a fragmentary view of a corner thereof. A support portion 218 for stacking purposes is mounted on an upper end of each corner portion of the box where a first side wall 201 and a second side wall 203 are connected together, opposite end portions of the support portion 218 being fixedly secured by an adhesive or the like to the first and second side walls 201 and 203, respectively. The support portion 218 is foldable as at 219.

The boxes of this embodiment can be stacked one upon another, since the support portions 218 for stacking purposes are mounted on the four corner portions of the box, respectively.

The folding of the box is effected in the same manner as described above for the embodiments of FIGS. 37 and 44, and when the box is to be folded, each support portion 218 is folded at the folding line 219 to be received in the corner portion.

Figure 48:
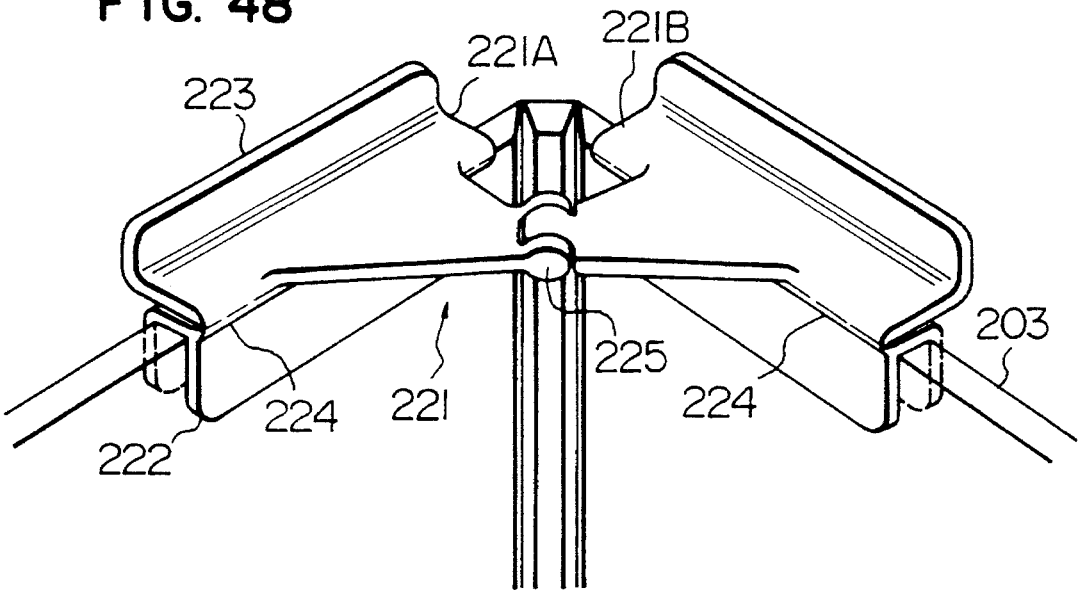
FIG. 48 is a perspective view of an important portion of a further modified box in an assembled condition.
Figure 49:
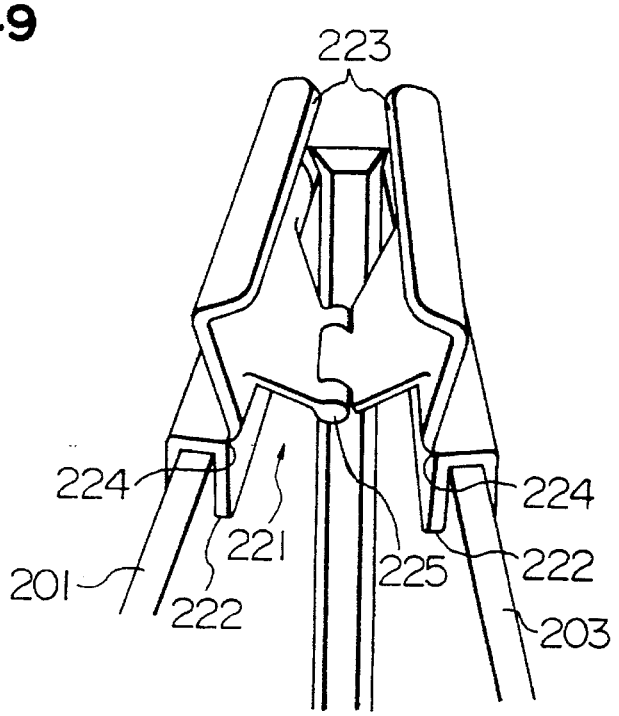
FIG. 49 is a view similar to FIG. 48, but showing the box during a folding operation.

FIGS. 48 and 49 are views showing an important portion of a further modified box. The box of this embodiment also has support portions for stacking purposes as in the above embodiments of FIGS. 44 and 47. The stacking support portion of this embodiment has receptive portions for preventing the stacked boxes from being displaced with respect to each other. More specifically, as shown in FIGS. 48 and 49, the support portion 221 for stacking purposes includes a pair of fitting portions 222 and a pair of receptive portions 223, and the support portion 221 is foldable at hinged portions 224 and 225. The fitting portions 222 of the support portion 221 are fitted respectively on an upper edge of a first side wall 201 and an upper edge of a second side wall 203, so that the support portion 221 is fixed to the corner portion of the box. The box portion is the same as that of the above embodiments, and is folded in the same manner. When the box is to be folded, the support portion 221 is folded as shown in FIG. 49.

More specifically, in this embodiment, the support portion 221 is foldable at the hinge portions 225 and 224. With this construction, when the box is to be folded, each support portion 221 is folded as shown in FIG. 49. Therefore, when the box is folded, the support portion 221 is disposed inwardly of the second side wall 203. Therefore, when the folded boxes are to be stacked one upon another, the support portions 221 will not affect this stacking operation, and the box will not be pressed against the receptive portion 223 of the adjacent box, so that the folded box will not be opened. For the reasons mentioned above, the hinge portions 224 are provided as shown in the drawings.

For forming the support portion 221, two halves 221A and 221B of this support portion 221 are made of a synthetic resin by molding such as injection molding, and the two halves 221A and 221B are connected together by the hinge portion 225. The support portion 221 may be of a one-piece construction, in which case indentations are formed in the support portion 221 to provide hinge portions.

The boxes of the above embodiments have no lid, but may have a lid. A box of the following embodiment has a lid.

Figure 50:
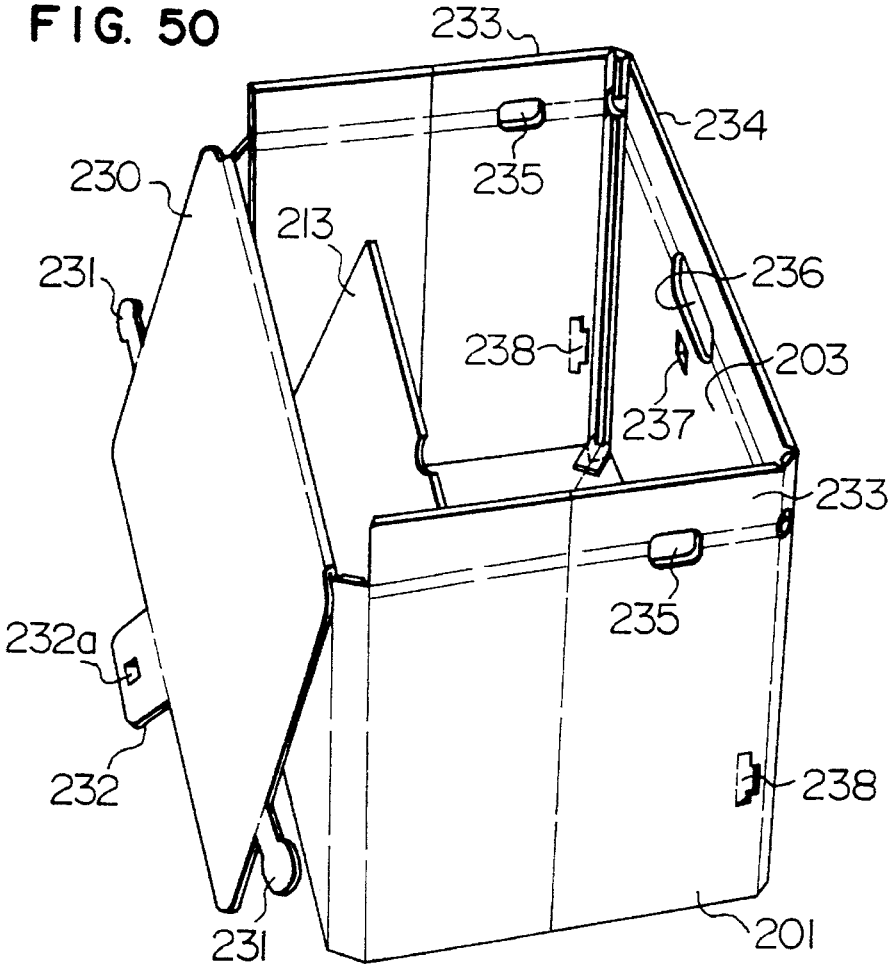
FIG. 50 is a perspective view of a further modified box in an assembled condition.

FIGS. 50 to 54 shows a further modified box. The box of this embodiment has a lid 230 formed integrally with one second side wall 203, as best shown in FIG. 50. The lid 230 has a pair of first pawls 231 and a second pawl 232 having a lock piece 232*a*. A first flap 233 is formed on an upper edge of each of two first side walls 201, and a second flap 234 is formed on an upper edge of the other second side wall 203. A first fixing hole 235 is formed at the boundary between each first side wall 201 and the first flap 233. A second fixing hole 236 is formed at the boundary between the second flap 234 and the second side wall 203.

Figure 51:
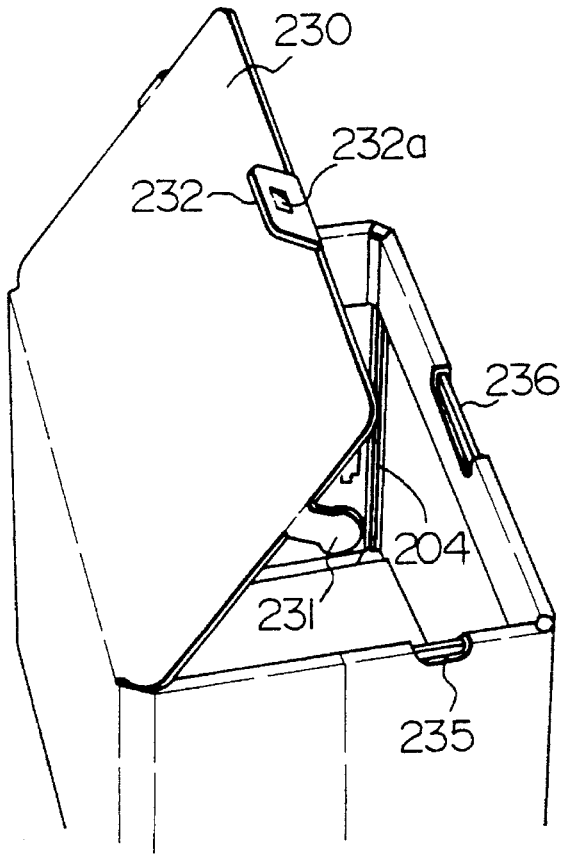
FIG. 51 is a perspective view of the box of FIG. 50, showing the process of closing a lid.
Figure 52:
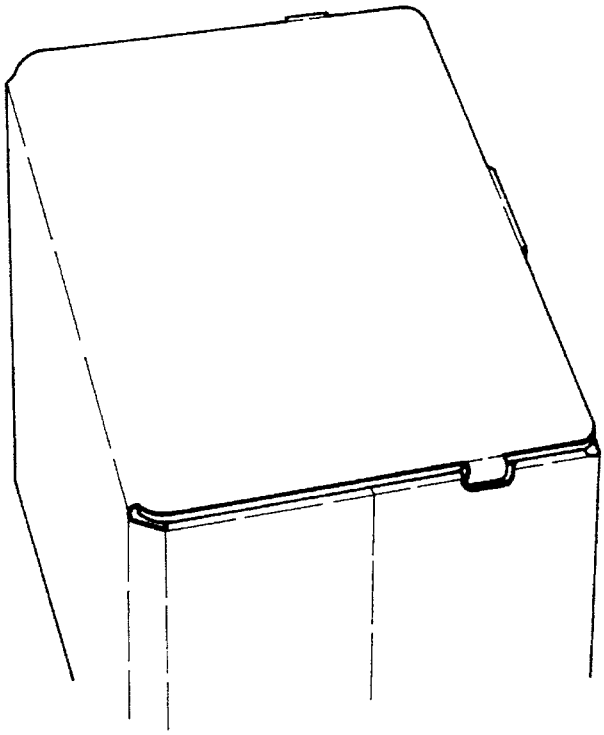
FIG. 52 is a perspective of the box of FIG. 50, with the lid held in its closed position.
Figure 53A:
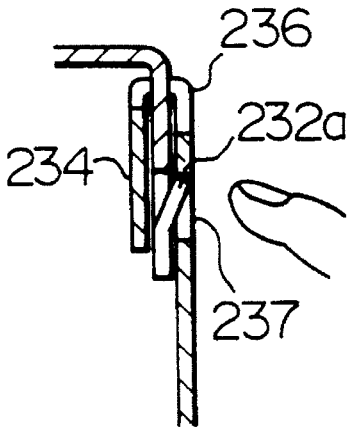
FIGS. 53A and 53B are views showing lock means for the lid of FIG. 50.
Figure 53B:
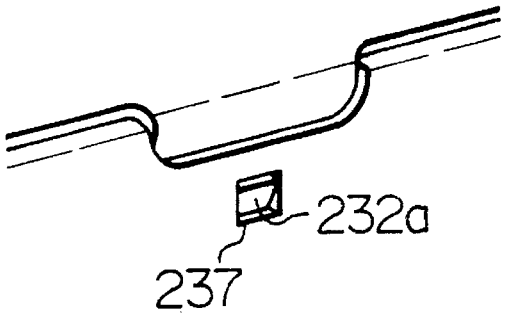
Figure 54:
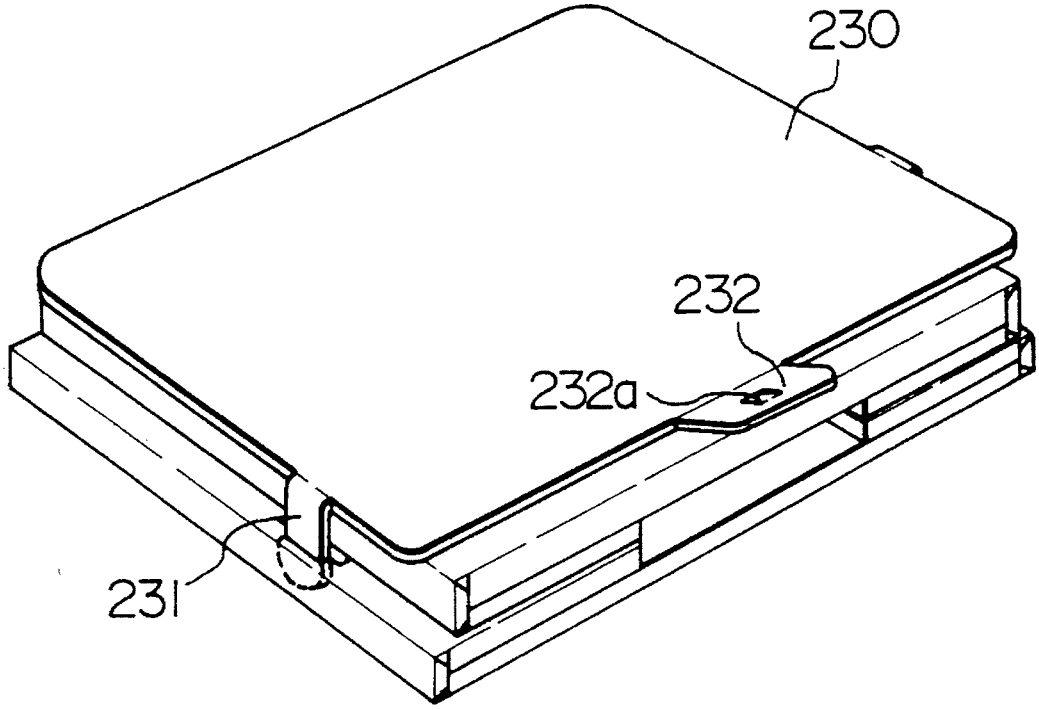
FIG. 54 is a perspective view of the box of FIG. 50 in a folded condition.

In this embodiment, the first flaps 233 and the second flap 234 are turned into the box as shown in FIG. 51, and then the lid 230 is closed in such a manner that the first pawls 231 are inserted respectively into the first holes 235, with the second pawl 232 inserted into the second hole 236, thereby retaining the lid 230 in its closed position, as shown in FIG. 52. Here, the second pawl 232 has the lock piece 232*a*, and in the closed position of the lid 230, the lock piece 232*a* is lockingly received in a hole 237 formed through the second side wall 203, thereby preventing the lid 230 from being opened, as shown in FIG. 53. For folding the box, the lock piece 232*a* is pressed, for example, by the finger to release the locking engagement of the lock piece 232*a* in the hole 237, so that the second pawl 232 can be removed from the hole 236, and the lid 230 can be opened as shown in FIGS. 53A and B. Then, the lid 230 is turned to its fully open position as shown in FIG. 50, and the flaps 233 and 234 are erected, and then the box is folded in the same manner as described for the above embodiments. More specifically, by folding each first side wall 201, the box can be folded in the same manner as described above for the embodiment of FIG. 37. The folded condition of the box is shown in FIG. 54. Connection members 204 connected to one second side wall 203 are different in width from connection members 204 connected to the other second side wall 203 as in the embodiment of FIG. 43, and therefore each pawl 231 can be received in a hole 238, as shown in FIG. 54.

In this embodiment, as in the embodiment of FIG. 43, the connection members 204 connected to one second side wall 203 are different in width from the connection members 204 connected to the other second side wall 203, and one of the two second side walls 203 is shorter than the other; however, all of the connection members may have the same width, in which case the two opposed second side walls 203 have the same length. In this case, a hole corresponding to the hole 238 is formed in the connecting member, and the pawl 231 is received in this hole.

Generally, a product made of a corrugated board, when folded, produces a restoring force. Therefore, the boxes of the present invention, when folded, tend to bulge by its restoring force. In this embodiment, however, this is suitably prevented by inserting the first pawls 231 into the holes 238, respectively.

Figure 55:
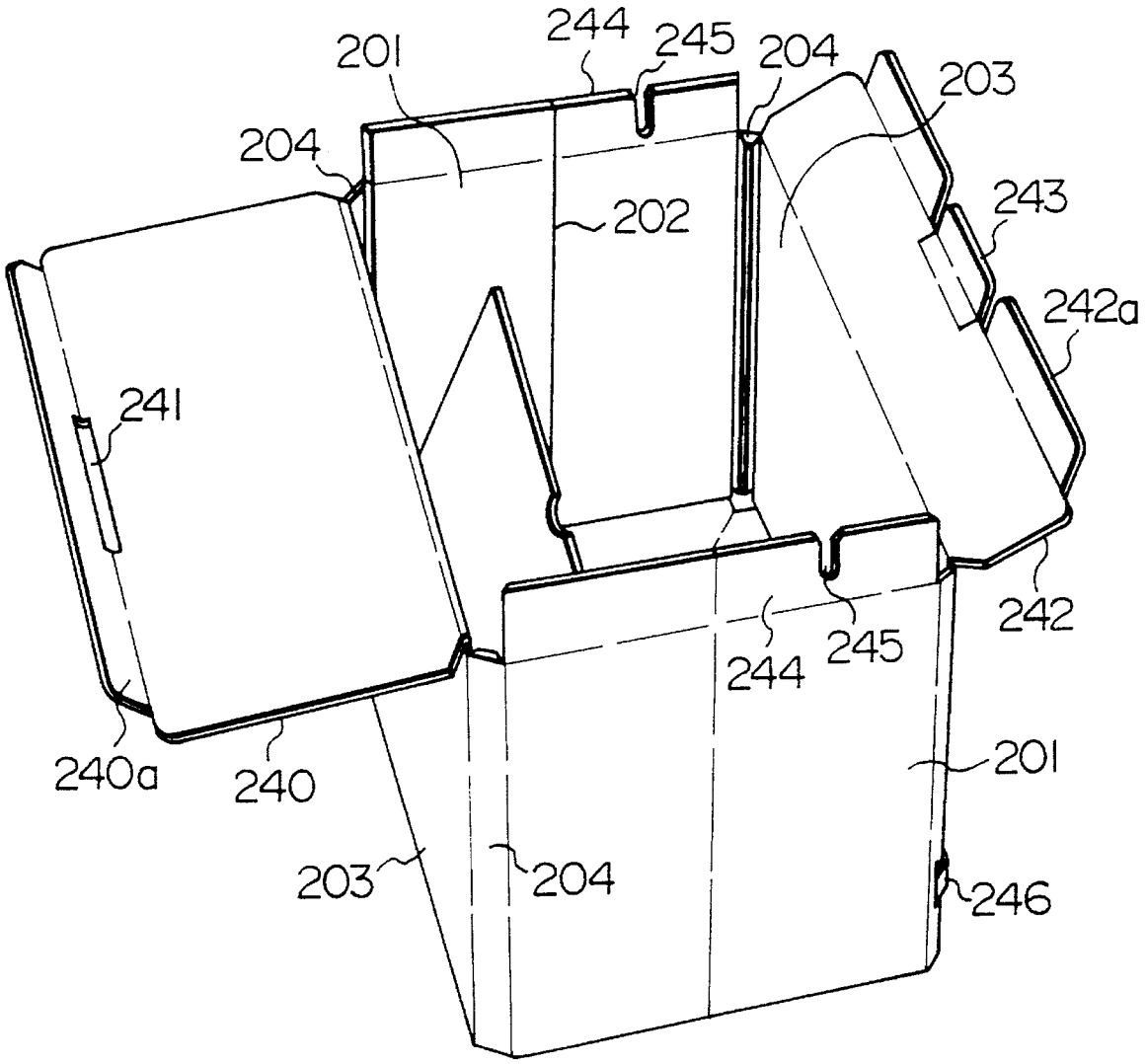
FIG. 55 is a perspective view of a further modified box in an assembled condition.
Figure 56:
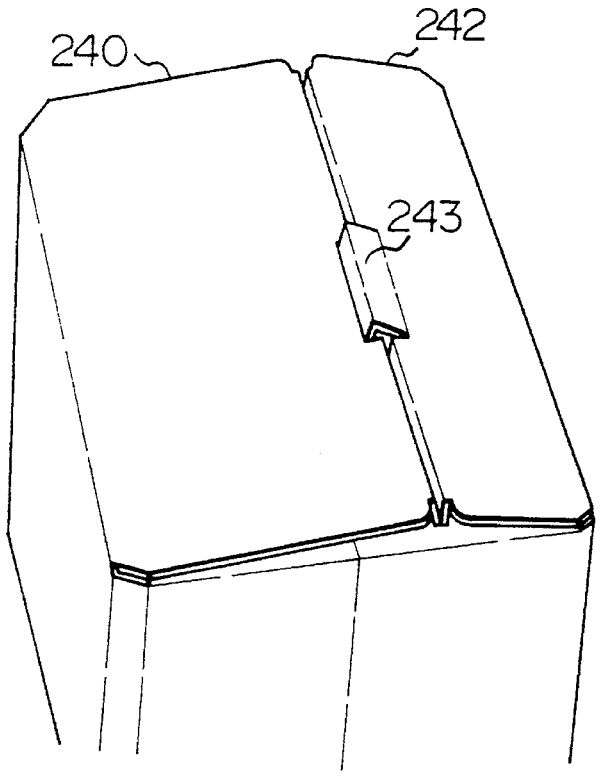
FIG. 56 is a perspective view of the box of FIG. 55, with a lid held in a closed position.
Figure 57:
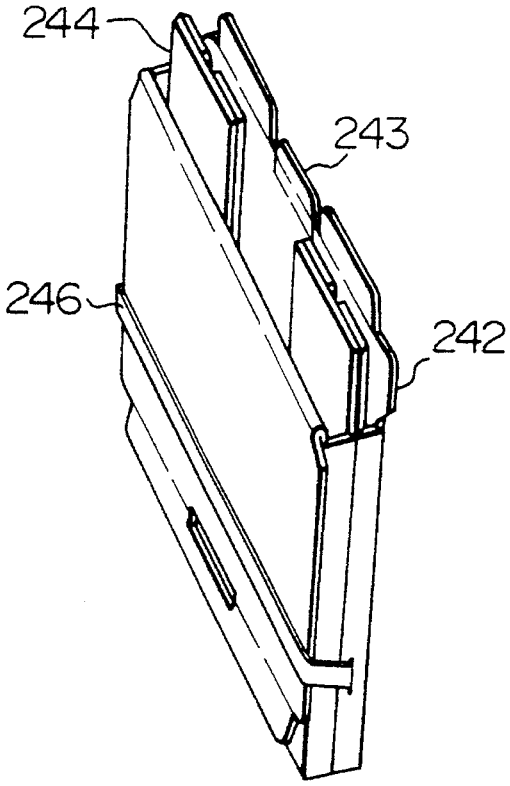
FIG. 57 is a perspective view of the box of FIG. 55 in a folded condition.

FIGS. 55 to 57 show a further modified box with lids. As shown in FIG. 55, two lids 240 and 242 are pivotally connected at their one ends to upper edges of two opposed second side walls 203, respectively. The lid 240 has a fixing hole 241, and the lid 242 has a pawl 243. A flap 244 is pivotally connected at its one end to an upper edge of each of two opposed first side walls 201, the flap 244 having a hinge at its central portion. Each of the two flaps 244 has a groove 245 into which distal end portions 240*a* and 242*a* of the two lids 240 and 242 are inserted when the two lids 240 and 242 are closed. The other basic construction of this box is the same as that of the embodiment of FIG. 37.

The box is assembled as shown in FIG. 55, and then the flaps 244 are turned inwardly into the box, and then the two lids 240 and 242 are closed as shown in FIG. 56. In this condition, the distal end portions 240*a* and 242*a* of the two lids 240 and 242 are received in the grooves 245, and the pawl 243 is received in the hole 241, thereby retaining the lids 240 and 242. For folding the box, the two lids 240 and 242 are pivotally moved outwardly into their fully open positions from the positions shown in FIG. 55. When each first side wall 201 is folded at a hinge 202, the flap 244 connected thereto is also folded at its central hinge, and the box is folded as shown in FIG. 57. Preferably, a stretchable belt 246 is connected to the box for preventing the folded box from being opened by its own restoring force.

Figure 58:
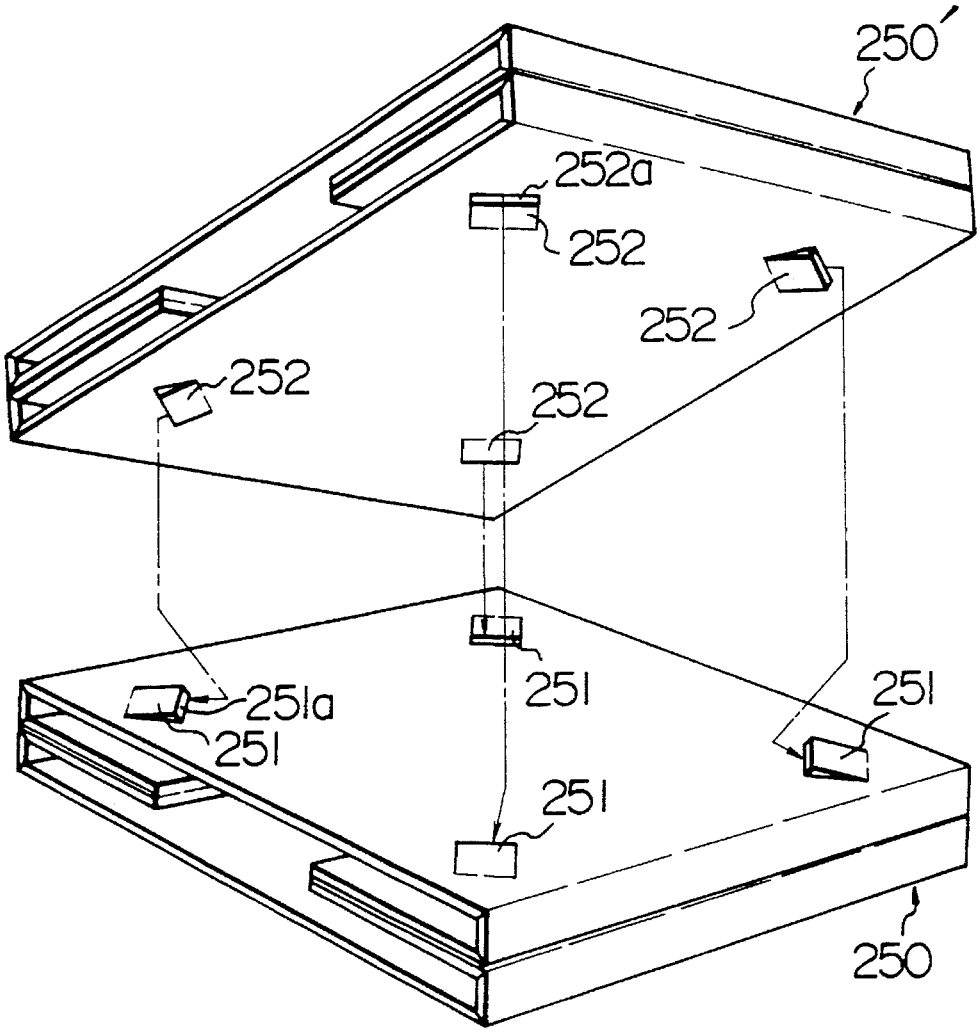
FIG. 58 is a view showing the stacking of folded boxes of the invention, which boxes have displacement prevention means.
Figure 59:
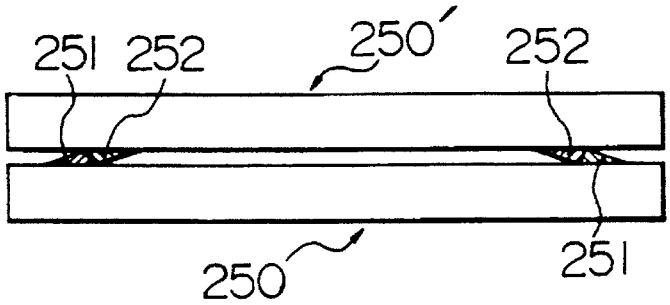
FIG. 59 is a side-elevational view of the folded boxes of FIG. 58 in a stacked condition.

FIGS. 58 and 59 show means for preventing stacked boxes in the folded condition from being displaced with respect to each other. FIG. 58 shows the manner of stacking upper and lower folded boxes 250' and 250. Displacement prevention projections 251 are formed respectively at four corner portions of an upper surface of the lower box 250, this projection 251 increasing in height progressively toward the center of the folded box. Displacement prevention projections 252 are formed respectively at four corner portions of a lower surface of the upper box 250', this projection 252 increasing in height progressively away from the center of the folded box. When the two boxes 250' and 250 are stacked, the displacement prevention projections 252 of the upper box 250' are respectively disposed inwardly of and immediately adjacent to the displacement prevention projections 251 of the lower box 250. With this arrangement, when the two boxes 250' and 250 are stacked, the displacement prevention projections 252 abut against their mating displacement prevention projections 251, respectively, thereby preventing the two boxes 250' and 250 from being displaced with respect to each other. By forming the projections 251 and the projections 252 on the opposite sides or surfaces of the folded box, respectively, a plurality of boxes can be stacked one upon another without inviting any displacement.

Figure 60A:
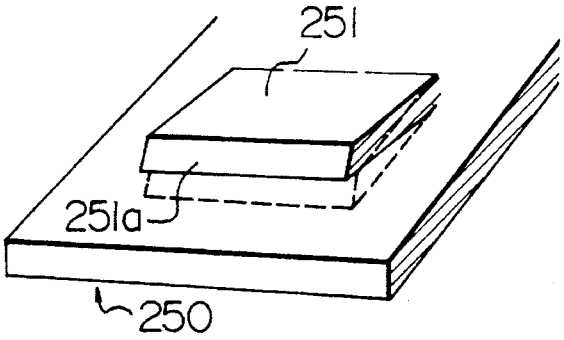
FIGS. 60A and 60B are fragmentary views of the box, showing a method of forming the displacement prevention means.
Figure 60B:
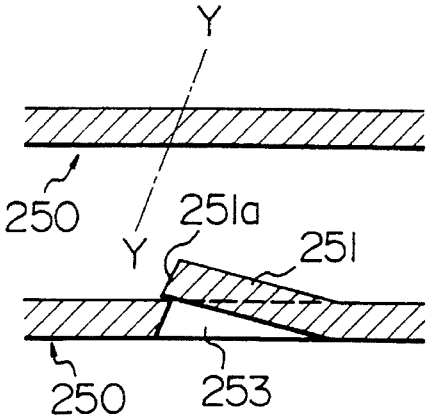

FIGS. 60A and B show a method of forming these displacement prevention projections. In these Figures, part of the second side wall 250 of the above embodiments is shown. U-shaped slits are formed respectively in four corner portions of the second side wall 250, and one side 251*a* of this U-shaped slit is inclined as indicated by a line Y—Y in FIG. 60B. Then, that portion of the second side wall surrounded by each U-shaped slit is raised out of the plane of the second side wall as shown in FIG. 60B. As a result, the displacement prevention projection 251 shown in FIG. 60A is formed. In a similar manner, the displacement prevention projection 252 is formed.

Figure 61A:
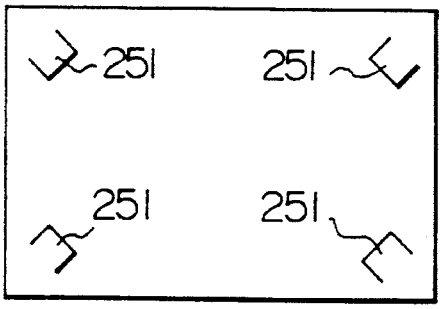
FIGS. 61A and 61B are views showing the arrangement of the displacement prevention means.
Figure 61B:
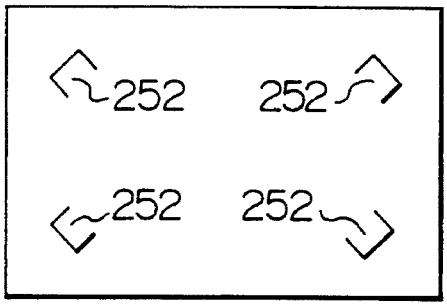
Figure 62A:
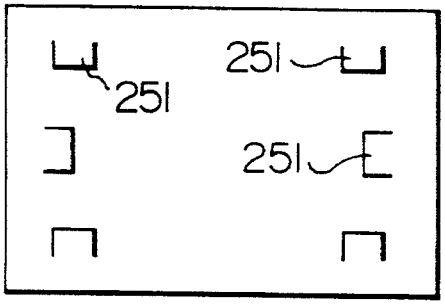
FIGS. 62A and 62B are views showing another arrangement of the displacement prevention means.
Figure 62B:
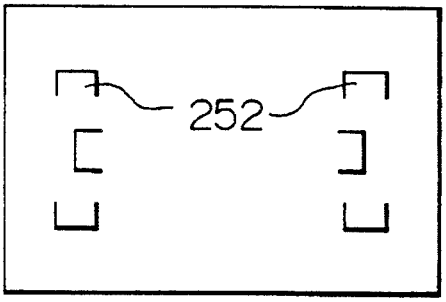

FIGS. 61A and B and 62A and B show the arrangement of the displacement prevention projections. FIGS. 61A and 62A show the upper side of the box, and FIGS. 61B and 62B show the lower side of the box. The arrangement of the projections shown in FIGS. 61A and B is the same as that of FIG. 58, and FIGS. 62A and B show a different arrangement.

Although each projection 251 is arranged to abut against its mating projection 252, these projections 251 and 252 may be so arranged that they can be directed in the same direction, and be disposed in registry with each other when the two folded boxes are stacked, in which case the projection 251 is received in a recess 253 (FIG. 60B), thereby preventing the two boxes from being displaced with respect to each other. Alternatively, the projections 251 and 252 may be arranged as shown in FIG. 58 except that the projections 251 are disposed in registry with the projections 252, respectively. With this arrangement, four pairs of mated projections 251 and 252 on two diagonal lines serve to prevent the displacement of the stacked boxes in all directions.

In the above embodiments, the box is made of a corrugated board, a relatively thin synthetic resin sheet or the like. However, some of the boxes of this kind are used to hold frozen products, and therefore need to be formed of a thermally-insulative material, and in some cases a foamed resin sheet having a relatively large thickness need to be used.

Figure 63:
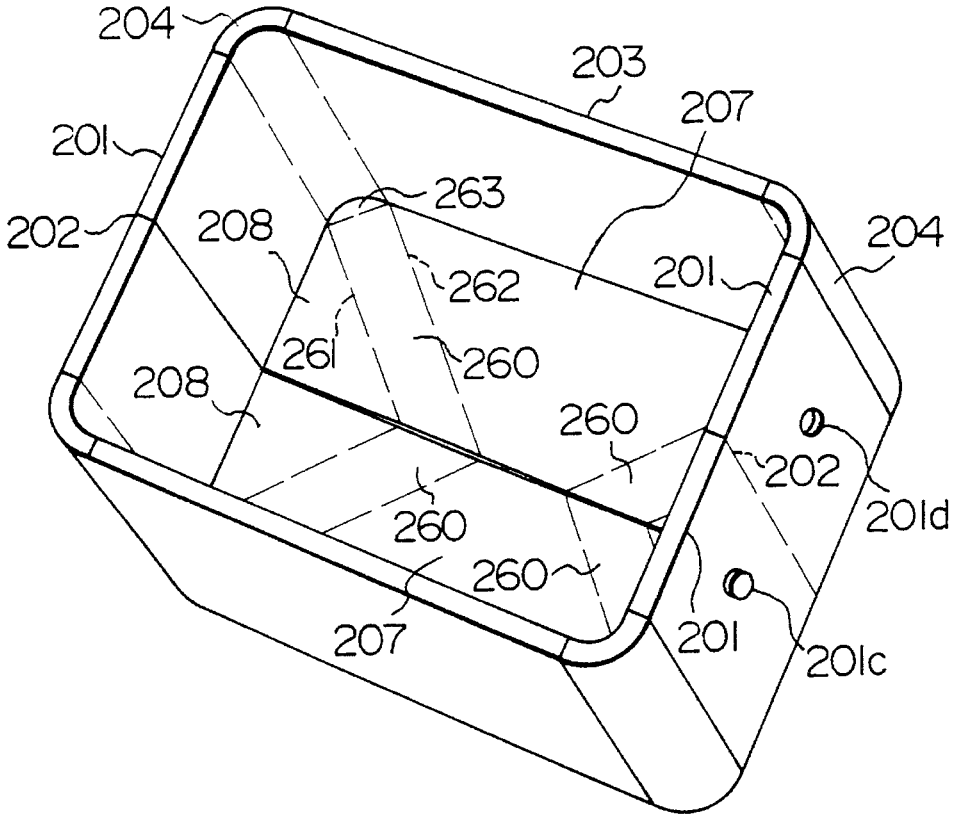
FIG. 63 is a perspective view of a further modified box in an,assembled condition.
Figure 64:
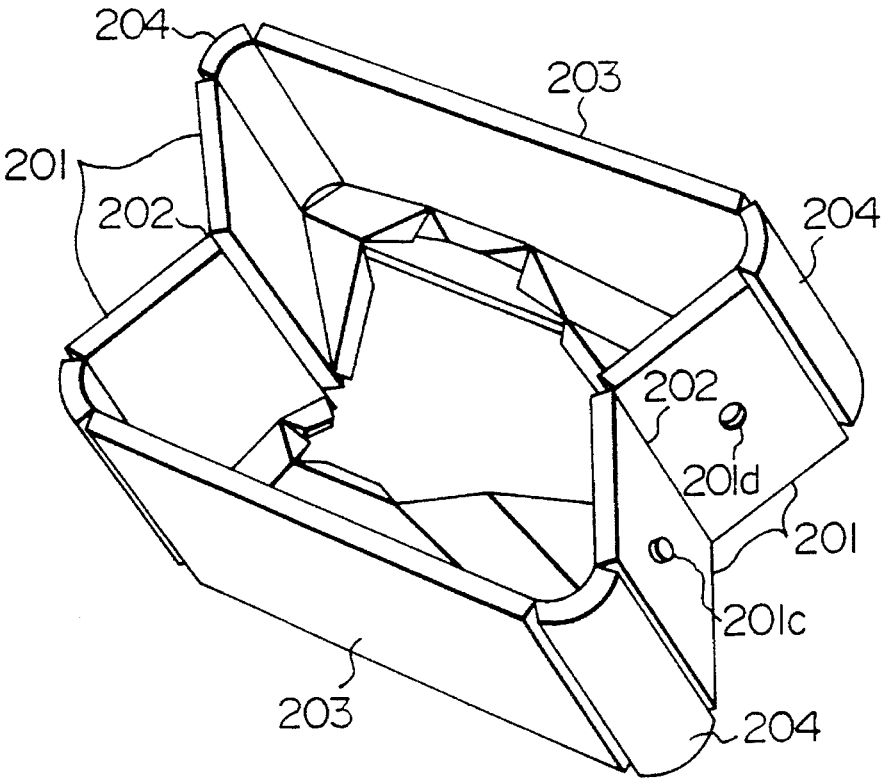
FIG. 64 is a perspective view of the box of FIG. 63 during a folding operation.
Figure 65:
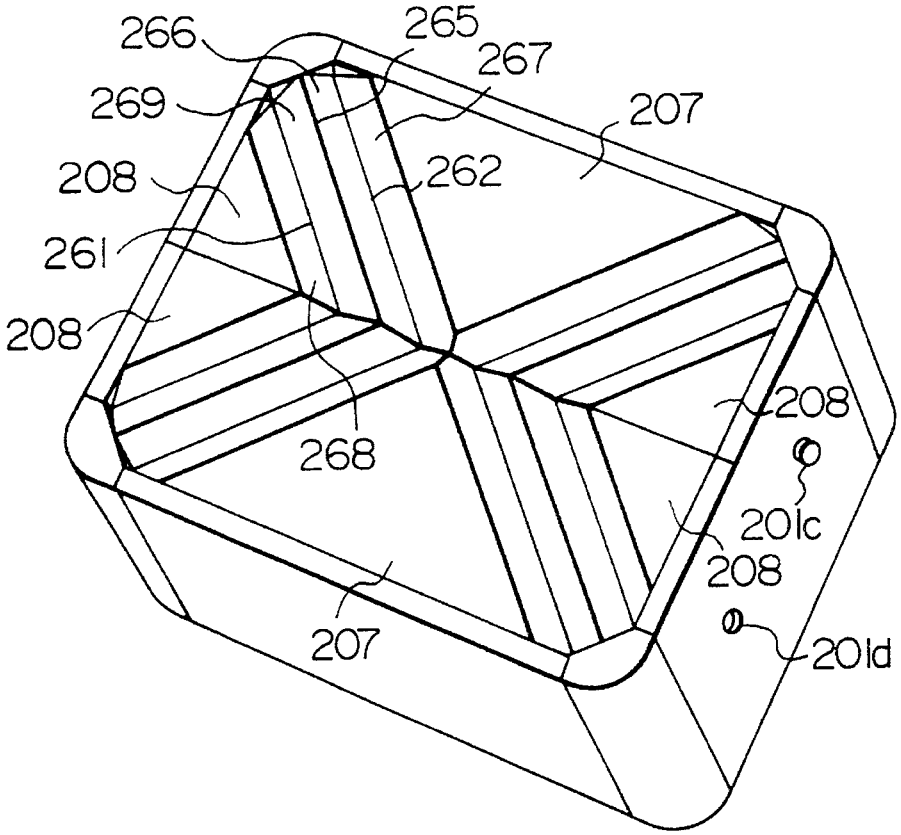
FIG. 65 is a perspective view of the box of FIG. 63 as seen from the bottom side thereof.
Figure 66:
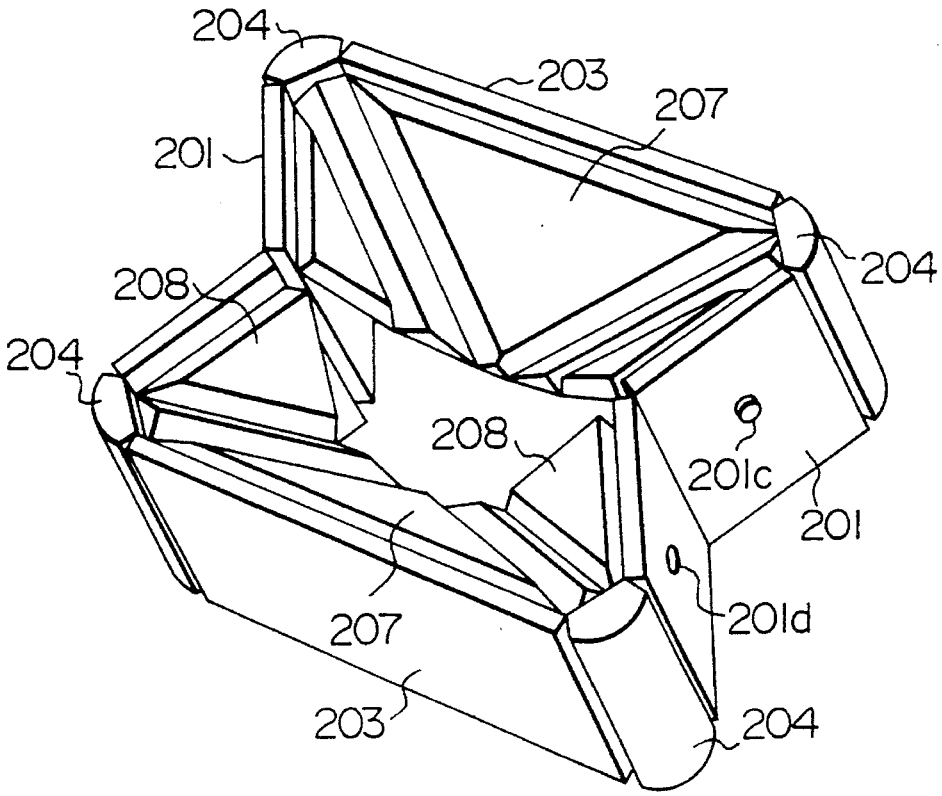
FIG. 66 is a perspective view of the box of FIG. 63 during a folding operation, as seen from the bottom side.
Figure 67:
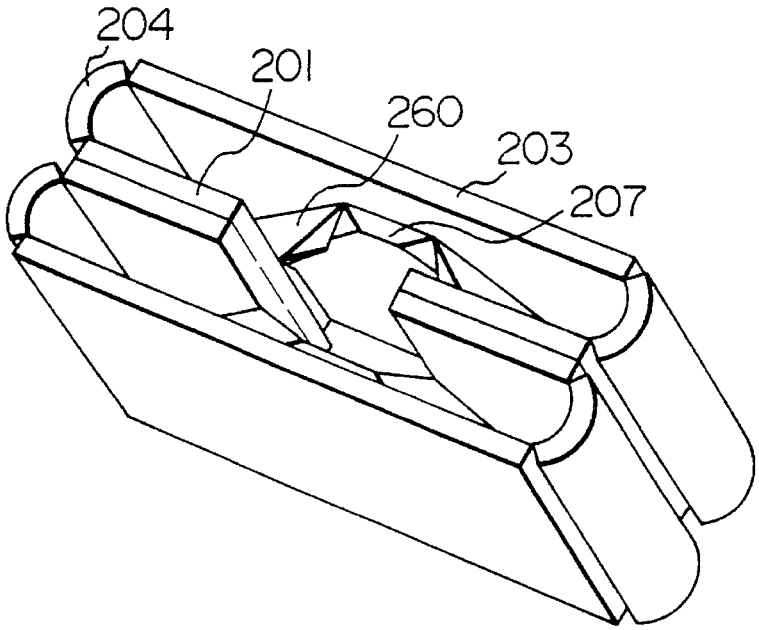
FIG. 67 is a perspective view of the box of FIG. 63 in a folded condition.

In view of this, FIGS. 63 to 66 shows a further modified folding box which is formed of a thick foamed resin sheet or board for thermal insulating purposes, or is formed of a thick board for other reasons. In this embodiment, also, two first side walls 201 each inwardly foldable at a hinge 202 are connected to two second side walls 203 by connection members 204 in such a manner that the first and second side walls 201 and 203 can be folded at hinges 205 and 206. As shown in FIG. 63, a bottom of the box is constituted by a pair of bottom plates each including a trapezoidal portion 207 and a pair of triangular portions 208 connected to the trapezoidal portion 207 by connection plates 260. These plate portions of the bottom plate are hingedly connected together by hinges 261, 262 and 263. With this construction, even when the trapezoidal portion 207 or the triangular portions 208 are made of a thick board or sheet, the bottom plate can be folded inwardly, and therefore the box can be folded. FIG. 65 is a bottom view of the box. In order that the bottom plate can be folded even when the trapezoidal portion 207 and the triangular portions 208 are made of a thick board, portions 265 and 267 are higher, and the hinge lines 261 and 262 are the lowest in FIG. 65, so that two recesses are formed and extend along the hinge lines 261 and 262, respectively. Namely, the connection plate 260 has a triangular transverse cross-section, and that edge portion of the trapezoidal portion 207 connected to the connection plate 260, as well as that edge portion of the triangular portion 208 connected to the connection plate 260, is inclined. The edge of the trapezoidal portion 207 connected to the connection plate 260 is the lowest in FIG. 65, and the hinge 262 is provided at the boundary between them. Similarly, the edge of the triangular portion 208 connected to the connection plate 260 is the lowest in FIG. 65, and the hinge 261 is provided at the boundary between them. Therefore, when the bottom plate is to be folded at the hinges 261 and 262 so as to turn the trapezoidal portion 207 and the triangular portions 208 inwardly, inclined surfaces 266 and 267 moves toward each other, and inclined surfaces 268 and 269 move toward each other, so that the box can be folded. FIGS. 64 and 66 show the process of folding the box, and FIG. 67 shows the folded condition of the box.

An engagement projection 201*c* and an engagement recess or hole 201*d* are provided at each of the first side walls 201, as shown in FIGS. 63 to 66. The projection 201*c* and the recess 201*d* are so positioned that when the box is folded, the projection 201*c* is fitted in the recess 201*d*, thereby preventing the box from being accidentally opened. When assembling the box, the projection 201*c* can be easily disengaged from the recess 201*d* by opening the folded first side wall 201.

Figure 68:
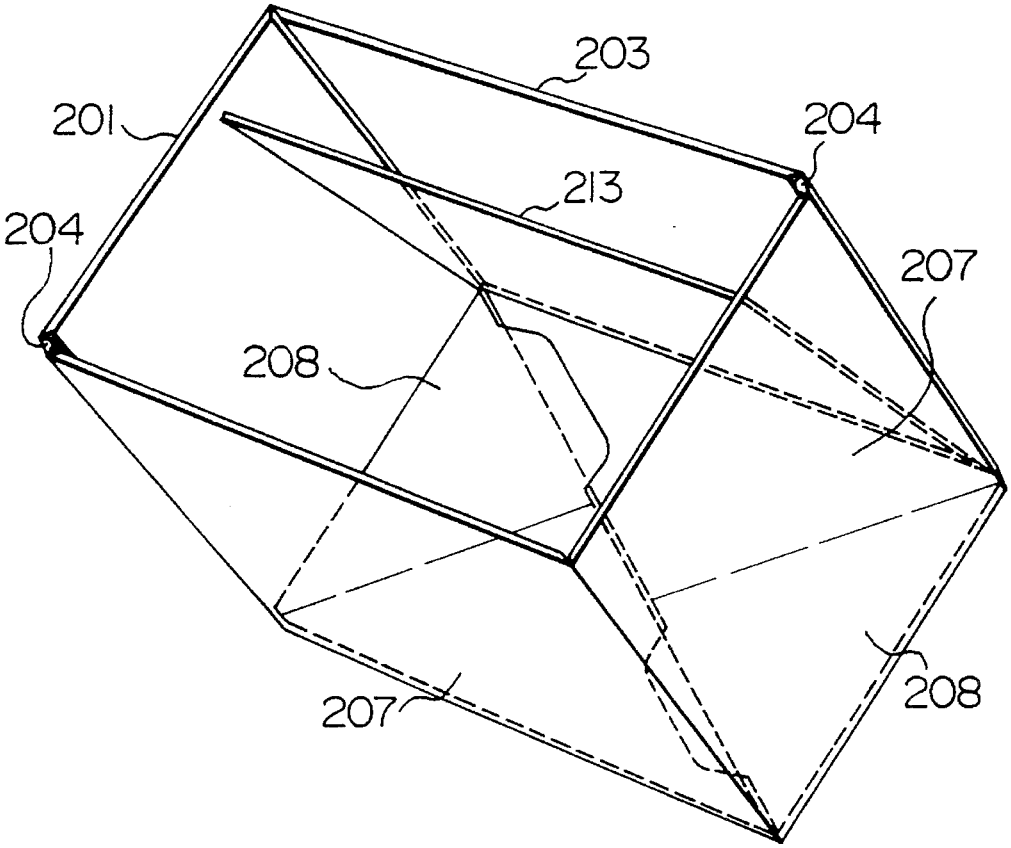
FIG. 68 is a perspective view of a further modified box.
Figure 69:
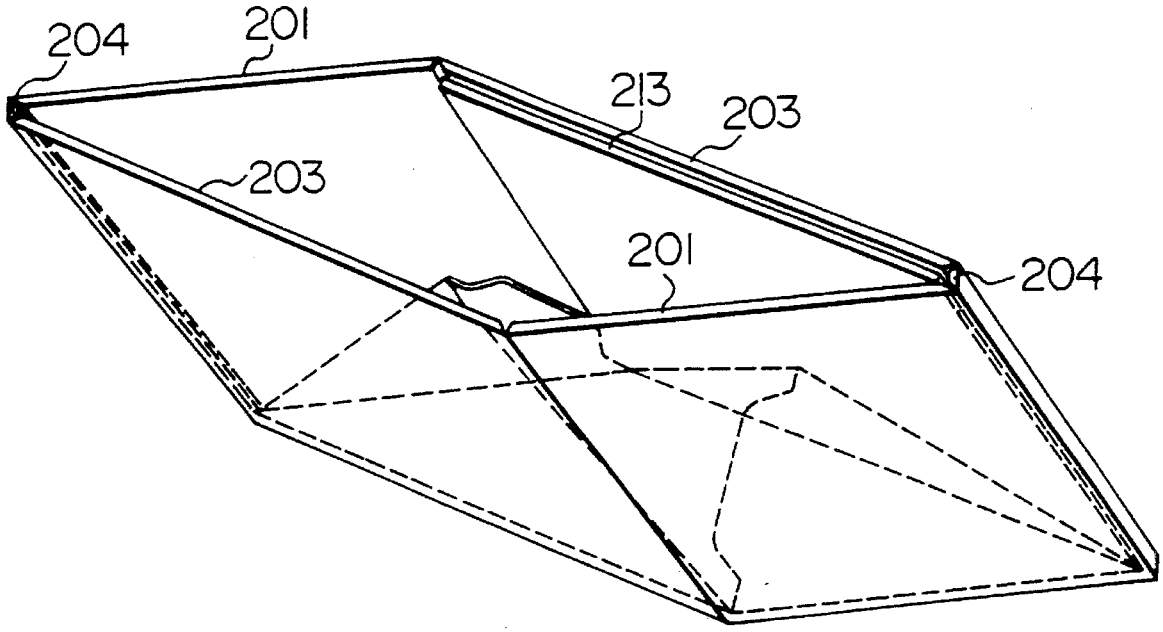
FIG. 69 is a perspective view of the box of FIG. 68 during a folding operation.

FIGS. 68 and 69 shows a further modified box utilizing the basic principle of the folding method of the invention. In this embodiment, each of first side wall 201 is not provided with a hinge, and therefore is composed of a single sheet or board which can not be folded. Only two connection members 204 are provided in diagonal relation. Although the bottom plate is constituted by the trapezoidal portion 207 and the triangular portions 208 in the above embodiments, a bottom plate is constituted by two triangular portions 207 and 208 in this embodiment. The construction of the box of this embodiment is simple as a whole.

In this embodiment, as in the above embodiments, the box can be folded by inwardly turning the triangular portions 207 and 208 constituting each bottom plate. However, since the first side walls 201 are not folded, the area of the folded box is relatively large. Despite this, the box of this embodiment is simple in construction, and can be easily folded, and can be produced at lower costs.

In this embodiment, when an external force is applied in a direction from each connection member 204 toward the center of the box, the triangular portions 207 and 208 act as triangular connection members to prevent the deformation of the box, and therefore the box is less liable to be deformed. However, external forces are applied in directions from the two diagonal corners of the box, having no connection member 204, toward the center of the box, the box can be deformed relatively easily. To prevent this, there has been proposed an arrangement in which an overlap portion formed on each triangular portion 208 is extended to a central portion to overlap and engage the upper surface of the triangular portion 207, thereby rendering the box less liable to be deformed. Even with such a construction, when a strong force is applied, there is a possibility that the bottom of the box is raised to disengage the overlap portions from the triangular portions 207, so that the box is deformed in its folding direction. This may lead to an accident during the transport of loads.

In this embodiment, the deformation of the box is prevented not by the engagement of the overlap portions, but by the provision of a reinforcement bottom plate 213 pivotally connected at one end to the lower edge of one second side wall 203. The reinforcement bottom plate 213 prevents the bottom plates from being folded upwardly. The reinforcement bottom plate 213 is firmly abutted at its distal end against the other second side wall 203, thereby preventing the bottom plates from being raised. A lock means for holding the reinforcement bottom plate 213 against the bottom plates may be provided to more positively prevent the bottom plates from being raised. The reinforcement bottom plate 213 also serves to prevent each first side wall 201 from being folded or bent, and therefore even when a strong force is applied to the box, the box will not be deformed. Preferably, the reinforcement bottom plate 213 in its upright condition is received in a space corresponding to the width of the connection member 204, and therefore the box can be folded more easily. The reinforcement bottom plate 213 cooperates with the bottom plates to provide a double bottom construction, and therefore the bottom of the box has an increased strength, so that the box can properly hold a heavy article or load. Furthermore, even when particulate matters such as powder are contained in the box, these will not leak from the box.

What is claimed is:

1. A folding box comprising:

first side walls each inwardly foldable at a vertically-extending hinge provided at a central portion thereof;

second side walls connected to said first side walls, said second side walls having end portions disposed generally perpendicularly to a remainder of said second side walls, so that said second side walls have a generally U-shaped cross-section; and two bottom plates each including a trapezoidal portion and a pair of triangular portions hingedly connected at respective folding lines to opposite side edges of said trapezoidal portion, said trapezoidal portions being hingedly connected respectively to a lower edge of said second wall portions, said triangular portions of each of said bottom plates being hingedly connected respectively to lower edges of said first side walls, and a boundary between said two bottom plates being disposed in registry with said central hinges of said first wall portions.

2. A folding box according to claim 1, in which each of said triangular portions of said bottom plates is connected to the lower edge of the corresponding first wall portion through a crease portion.

3. A folding box according to claim 1 or claim 2, in which a reinforcement plate is pivotally connected at its one end to an inner surface of one of said second side walls at the lower edge of said second side wall, said reinforcement plate having generally the same shape as a shape defined by said two bottom plates, and having generally the same area as combined areas of said two bottom plates.

4. A folding box according to claim 1 or claim 2, in which two reinforcement plates are pivotally connected at their one ends respectively to inner surfaces of said two second side walls at the lower edges of said second side walls, wherein when said two reinforcement plates are laid flat against said bottom plates in an assembled condition of said box, distal ends of said two reinforcement plates are abutted against each other.

* * * * *